US009595755B2

(12) United States Patent
Ng et al.

(10) Patent No.: US 9,595,755 B2
(45) Date of Patent: Mar. 14, 2017

(54) GROUND INDEPENDENT MULTI-BAND ANTENNA ASSEMBLIES

(71) Applicant: Laird Technologies, Inc., Earth City, MO (US)

(72) Inventors: Kok Jiunn Ng, Penang (MY); Tshu Pin Chee, Penang (MY); Tze Yuen Ng, Kedah (MY); Xin Wen Teoh, Penang (MY)

(73) Assignee: Laird Technologies, Inc., Earth City, MO (US)

( * ) Notice: Subject to any disclaimer, the term of this patent is extended or adjusted under 35 U.S.C. 154(b) by 58 days.

(21) Appl. No.: 14/827,469

(22) Filed: Aug. 17, 2015

(65) Prior Publication Data

US 2015/0357714 A1 Dec. 10, 2015

Related U.S. Application Data

(63) Continuation-in-part of application No. PCT/US2014/058874, filed on Oct. 2, 2014.

(30) Foreign Application Priority Data

Oct. 4, 2013 (MY) ..... PI2013701873

(51) Int. Cl.
*H01Q 1/48* (2006.01)
*H01Q 1/12* (2006.01)
(Continued)

(52) U.S. Cl.
CPC ..... *H01Q 1/48* (2013.01); *H01Q 1/1214* (2013.01); *H01Q 1/3275* (2013.01); *H01Q 9/0407* (2013.01); *H01Q 21/28* (2013.01)

(58) Field of Classification Search
CPC ..... H01Q 1/48; H01Q 1/38; H01Q 1/24
(Continued)

(56) References Cited

U.S. PATENT DOCUMENTS 6,683,570 B2 1/2004 Skladany et al.
7,696,931 B2 4/2010 Kim et al.
(Continued)

FOREIGN PATENT DOCUMENTS

KR 10-2005-0040994 5/2005
WO WO 2015/051153 4/2015

OTHER PUBLICATIONS

Taiwan Office Action and Search Report (and English translation) from TW Application No. 103134724 filed Oct. 6, 2014 which claims priority to the same parent application as the instant application, 7 pages.

(Continued)

*Primary Examiner* — Huedung Mancuso
(74) *Attorney, Agent, or Firm* — Harness, Dickey & Pierce, P.L.C.

(57) ABSTRACT

According to various aspects, exemplary embodiments are disclosed of ground independent multi-band antenna assemblies. In an exemplary embodiment, a ground independent multi-band antenna assembly is operable within at least a first frequency range and a second frequency range different than the first frequency range. The antenna assembly generally includes an annular ground element, a feed element, a patch element, and a high band element. The feed element includes a feeding point and a shorting point electrically connected to the annular ground element. The patch element is electrically shorted to the annular ground element by the feed element. The high band element is electrically connected to the feed element.

18 Claims, 24 Drawing Sheets

(51) Int. Cl.
*H01Q 1/32* (2006.01)
*H01Q 9/04* (2006.01)
*H01Q 21/28* (2006.01)

(58) Field of Classification Search
USPC ..... 343/848
See application file for complete search history.

(56) References Cited

U.S. PATENT DOCUMENTS 7,999,757 B2 8/2011 Du
8,310,404 B2 * 11/2012 Kishimoto ..... G08G 1/095 343/720
8,807,791 B2 * 8/2014 Huang ..... H05B 33/0842 362/217.05
9,331,391 B2 * 5/2016 Chien ..... H01Q 9/42
2004/0233109 A1 11/2004 Ying et al.
2010/0188301 A1 * 7/2010 Kishimoto ..... G08G 1/095 343/721
2011/0275025 A1 11/2011 Lint et al.
2011/0275027 A1 11/2011 Lint et al.

OTHER PUBLICATIONS

International Search Report and Written Opinion dated Nov. 25, 2014 for PCT Application No. PCT/US2014/058874 filed Oct. 2, 2014 (published as WO 2015/051153 on Apr. 9, 2015) which is the parent application to the instant application; 7 pages.
Examination Report dated Jun. 30, 2015 (and English Summarized Translation) from Taiwan utility model application No. 103217761 which claims priority to the same parent application as the instant application; 7 pages.

* cited by examiner

| | 824 | 869 | 894 | 1710 | 1785 | 1850 | 1920 | 1960 | 1990 | 2110 | 2170 |
|---|---|---|---|---|---|---|---|---|---|---|---|
| —— Ant on Metal Ground Plane | 1.50 | 2.39 | 1.86 | 5.48 | 4.17 | 3.76 | 3.63 | 3.28 | 3.59 | 3.84 | 3.99 |
| - - - Ant on Plastic Casing | 1.38 | 1.86 | 1.79 | 2.02 | 1.96 | 1.76 | 2.59 | 3.42 | 3.39 | 2.90 | 2.10 |

GROUND INDEPENDENT MULTI-BAND ANTENNA ASSEMBLIES

CROSS-REFERENCE TO RELATED APPLICATIONS

This application is a continuation-in-part of PCT Application No. PCT/US2014/058874 filed Oct. 2, 2014 (published as Wo 2015/051153 on Apr. 9, 2015) which, in turn, claims the benefit of and priority to Malaysian Patent Application No. PI 2013701873 filed Oct. 4, 2013. The entire disclosures of the above applications are incorporated herein by reference.

FIELD

The present disclosure generally relates to ground independent multi-band antenna assemblies that may also have a low profile.

BACKGROUND

This section provides background information related to the present disclosure which is not necessarily prior art.

Conventional small and low profile antennas for Machine to Machine (M2M) and vehicular applications are typically ground dependent, such that the antenna may only be able to operate at a desired frequency range when used with (e.g., mounted, installed, placed on, etc.) a large ground plane. A ground dependent conventional small and low profile antenna may thus have limited flexibility in terms of application because the antenna may be detuned significantly for different mounting scenarios, e.g., when not used with a large ground plane.

SUMMARY

This section provides a general summary of the disclosure, and is not a comprehensive disclosure of its full scope or all of its features.

According to various aspects, exemplary embodiments are disclosed of ground independent multi-band antenna assemblies. In an exemplary embodiment, a ground independent multi-band antenna assembly is operable within at least a first frequency range and a second frequency range different than the first frequency range. The antenna assembly generally includes an annular ground element, a feed element, a patch element, and a high band element. The feed element includes a feeding point and a shorting point electrically connected to the annular ground element. The patch element is electrically shorted to the annular ground element by the feed element. The high band element is electrically connected to the feed element.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 13:
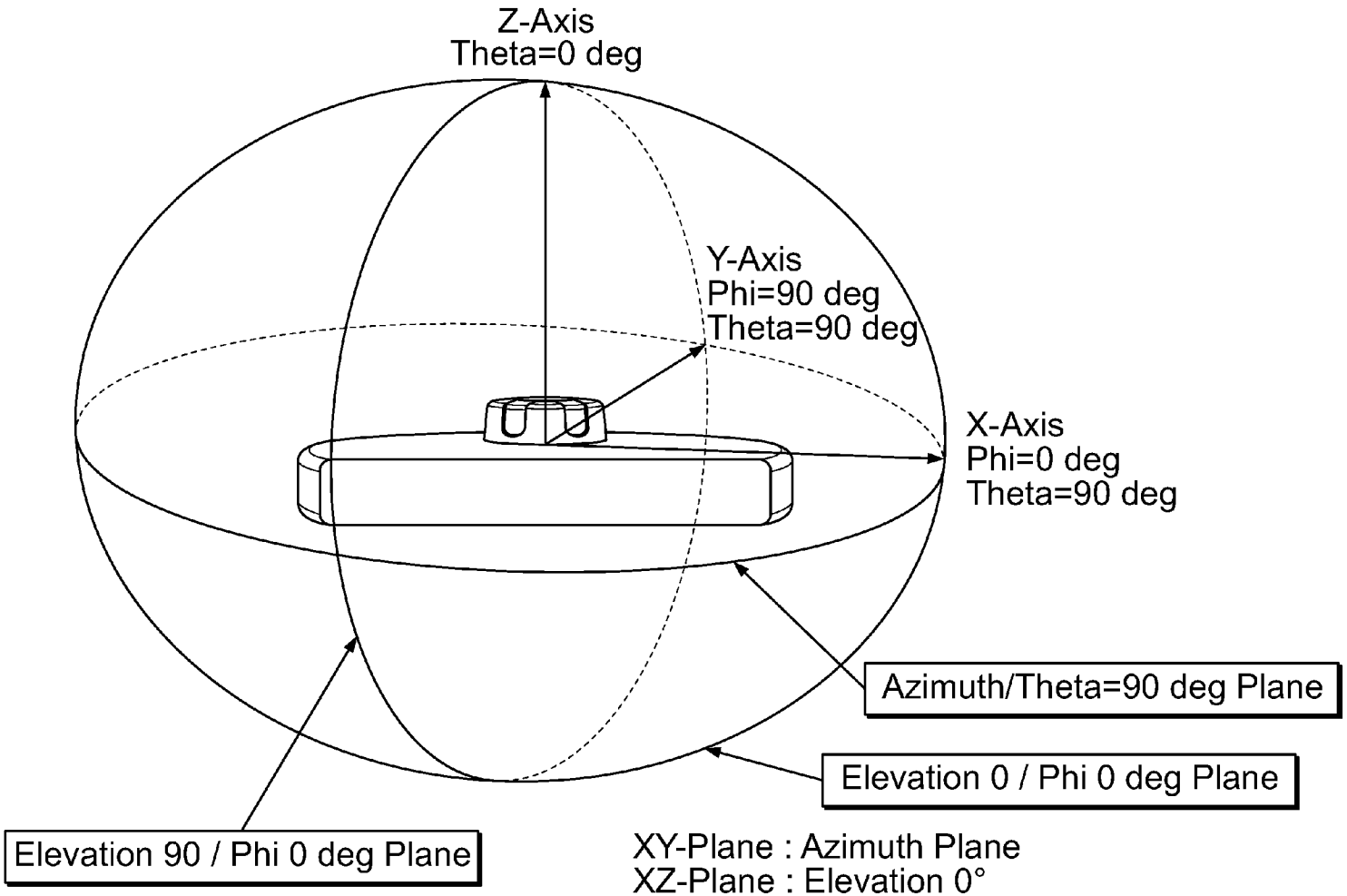
FIG. 13 shows the pattern orientation and planes relative to the prototype antenna during radiation pattern testing.
Figure 14:
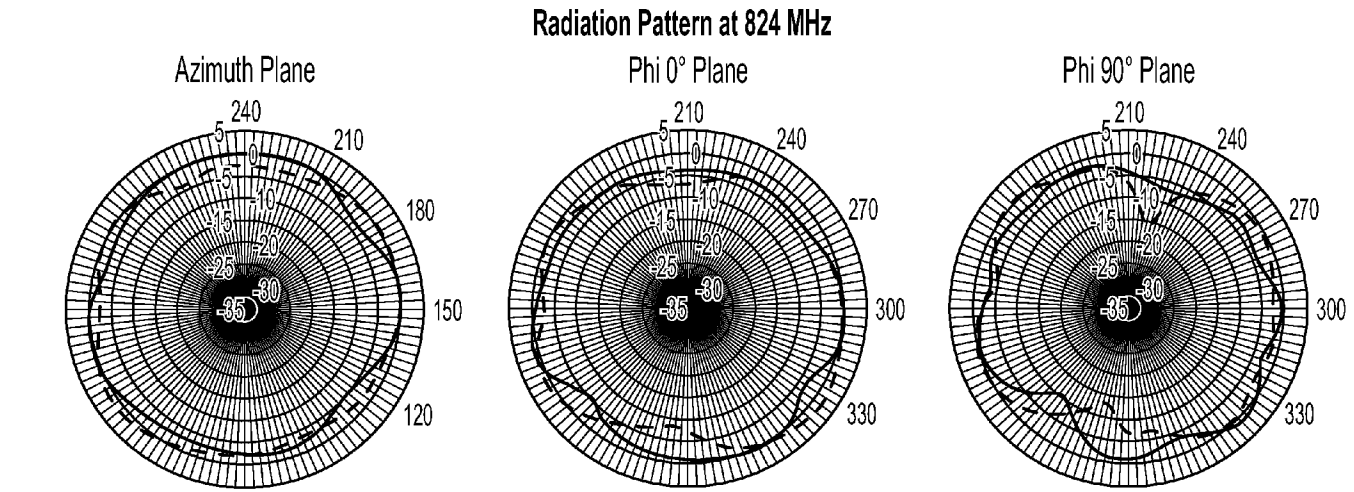
FIGS. 14 through 19 illustrate radiation patterns (Azimuth plane, Phi 0° plane, and Phi 90° plane) measured for the prototype antenna on the metal ground plane (FIG. 7) and on the plastic casing (FIG. 8) with the pattern orientation shown in FIG. 13 at frequencies of about 824 MHz, 894 MHz, 1710 MHz, 1850 MHz, 1990 MHz, and 2170 MHz, respectively.
Figure 15:
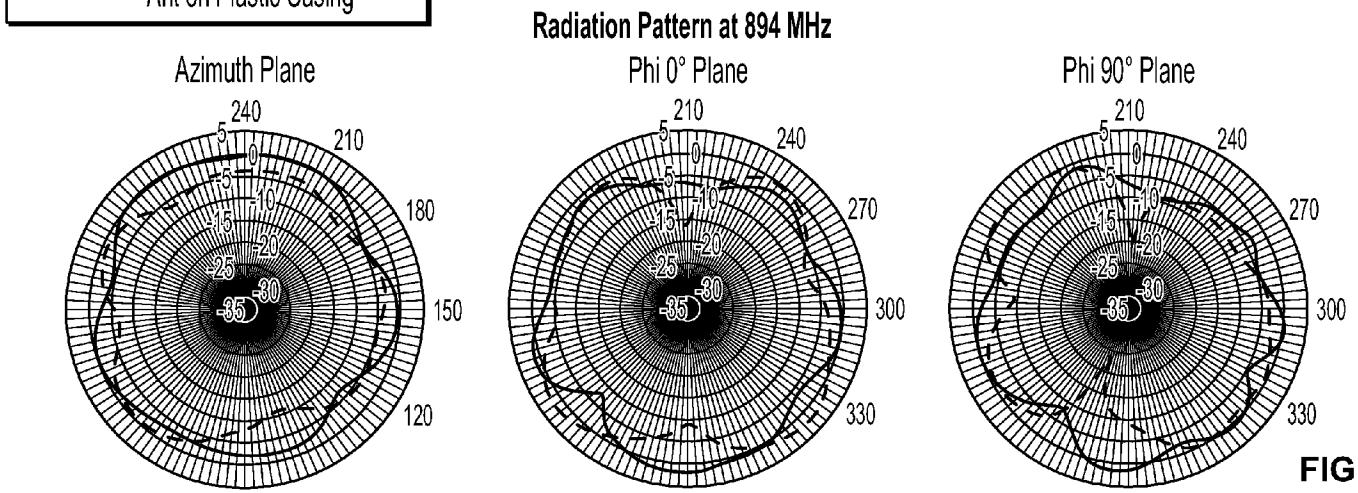
Figure 16:
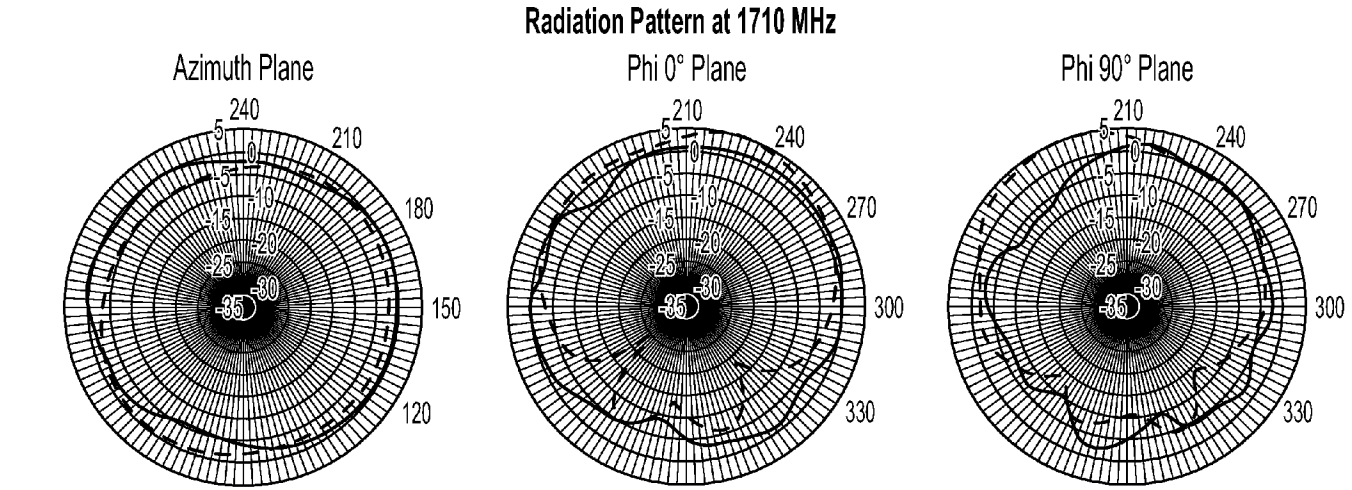
Figure 17:
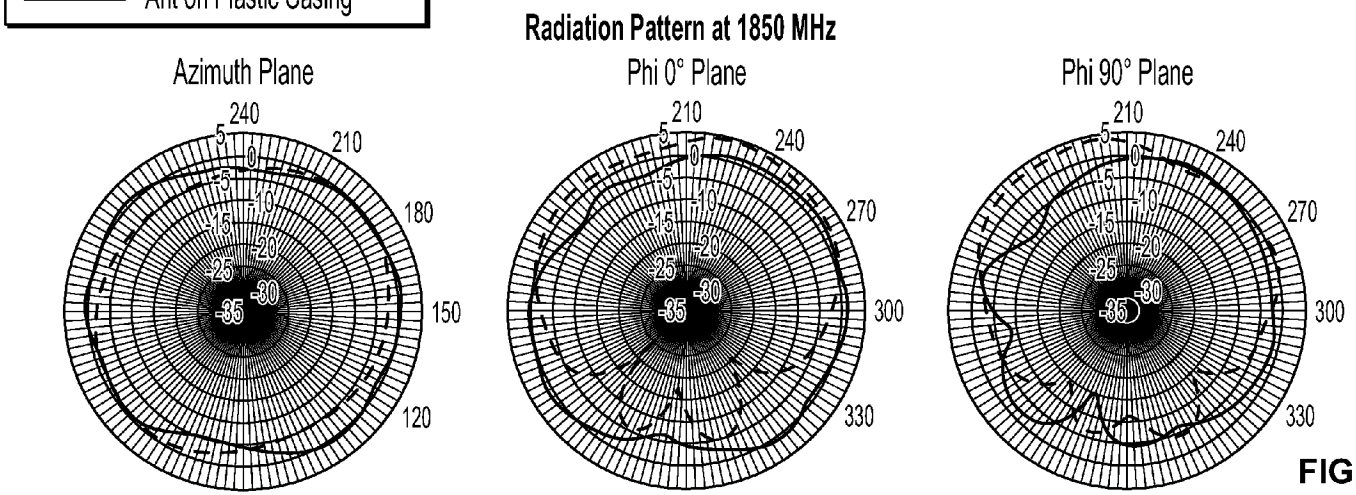
Figure 18:
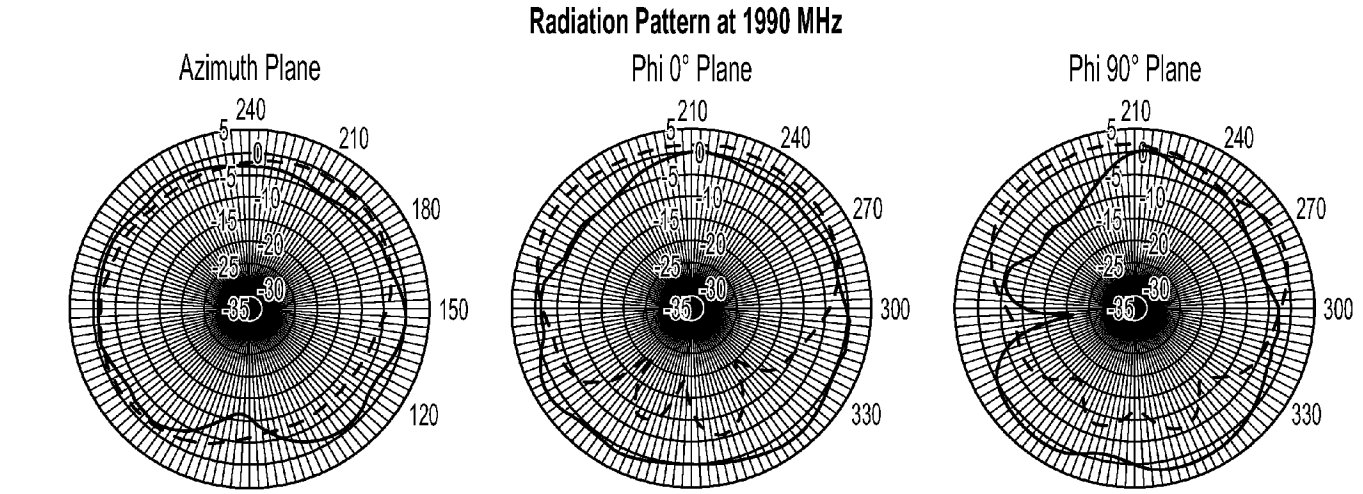
Figure 19:
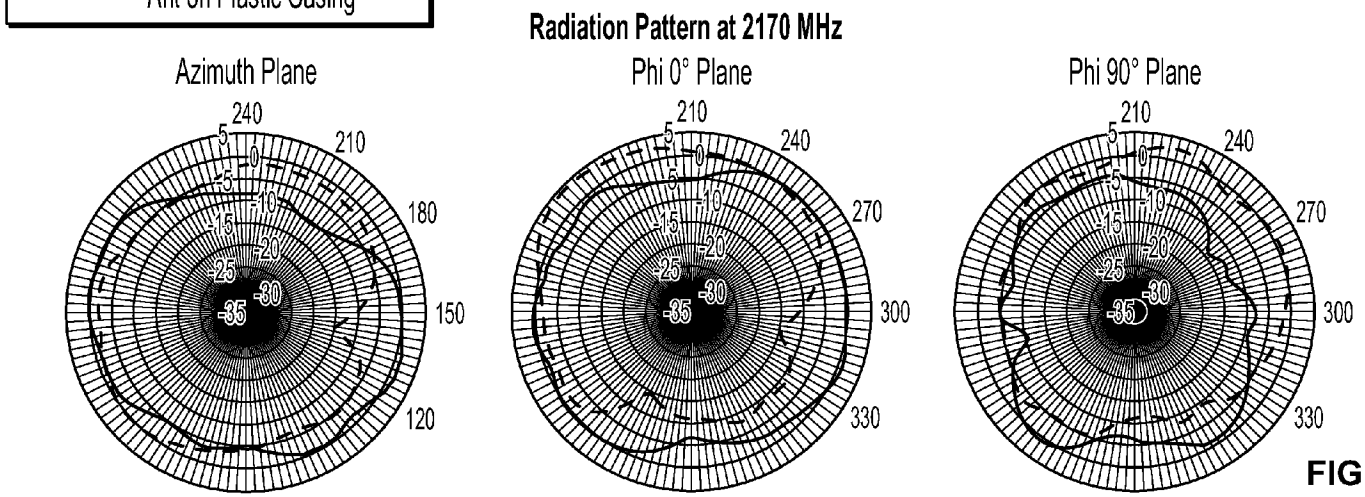
Figure 20:
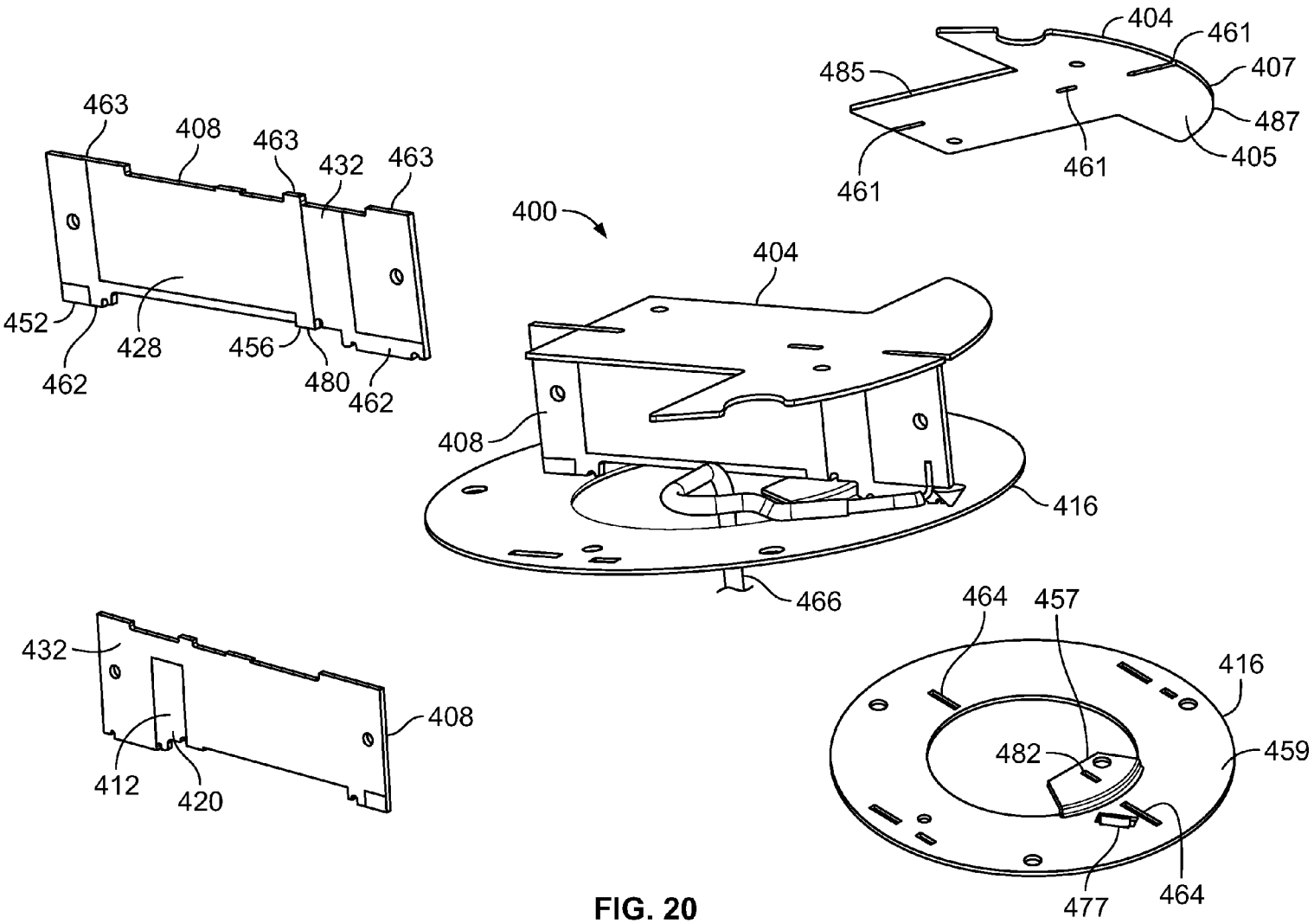
FIG. 20 is a perspective view of a ground independent multi-band antenna assembly according to an exemplary embodiment and also illustrating examples of the patch element, feed element, high band element, and annular ground plane or element.
Figure 21:
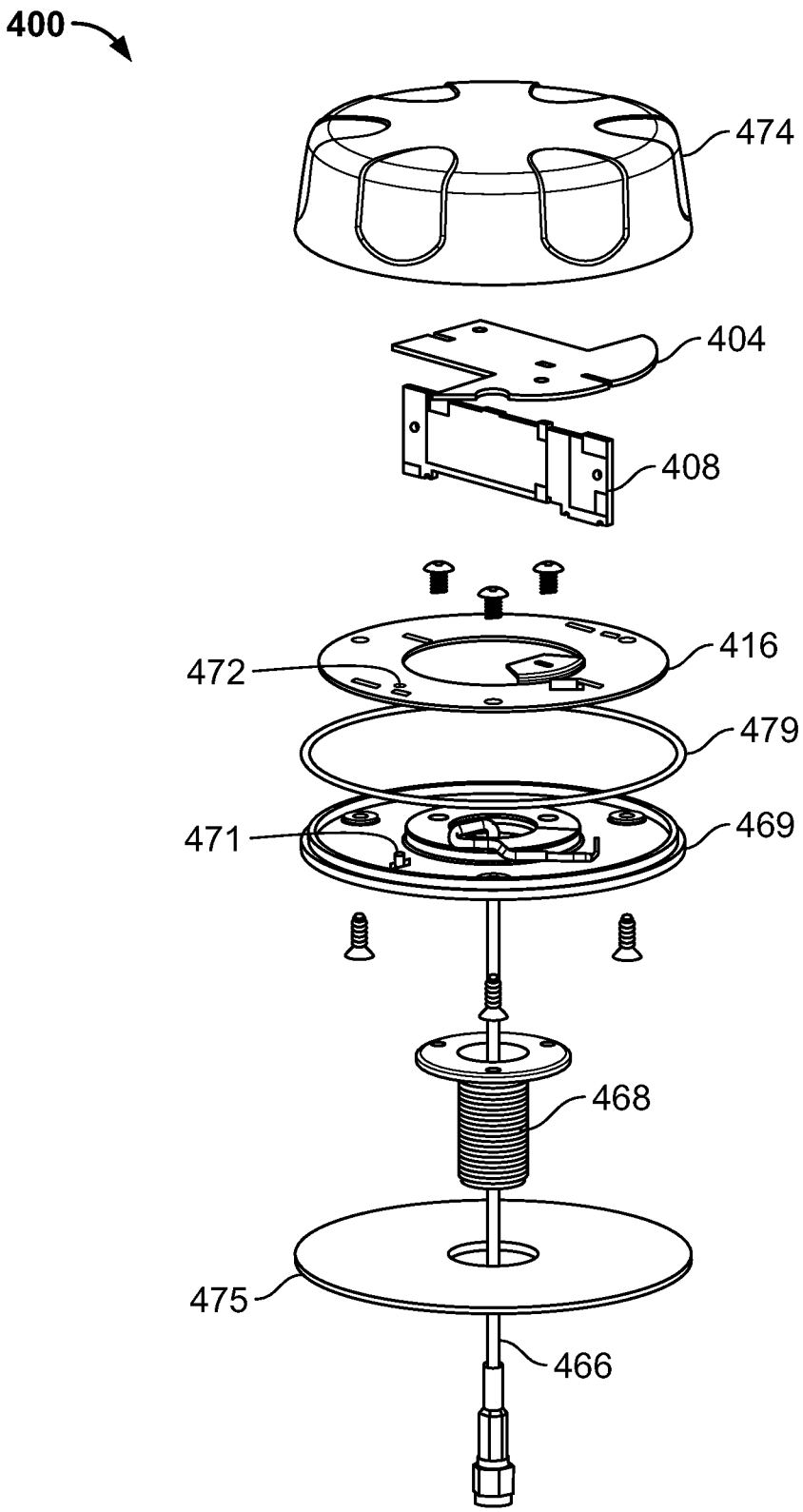
Figure 22A:
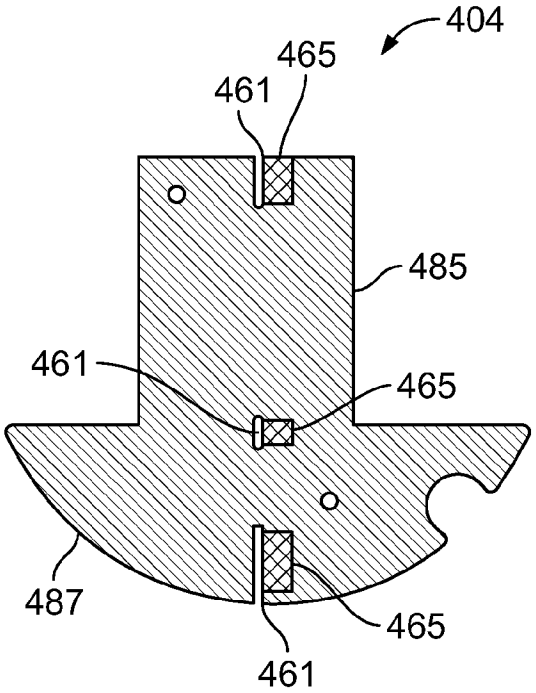
Figure 22A:
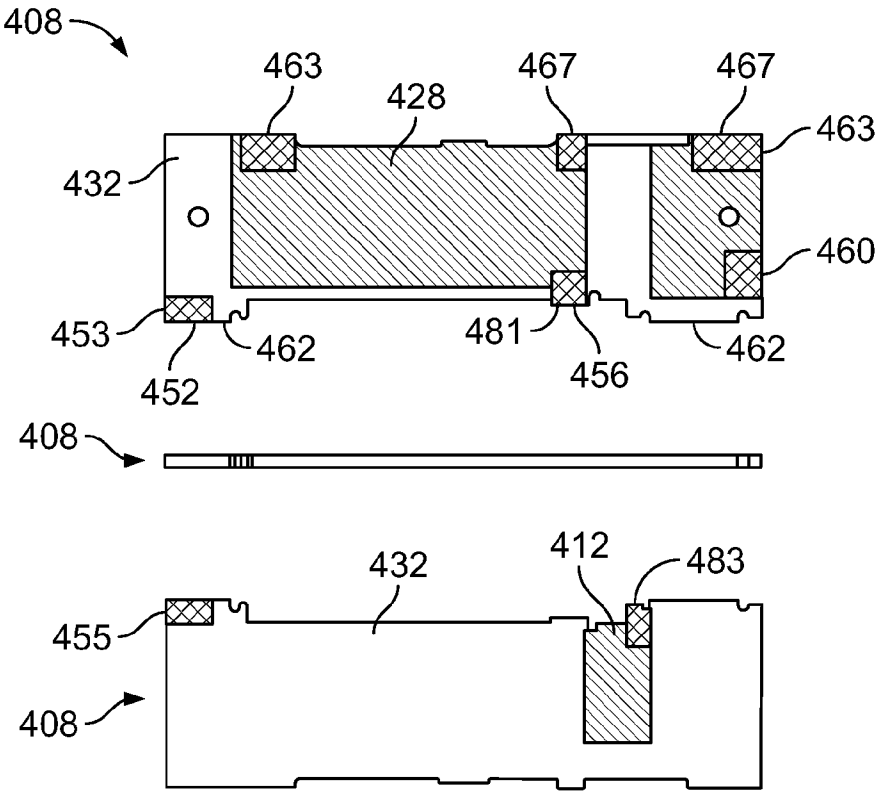
Figure 22B:
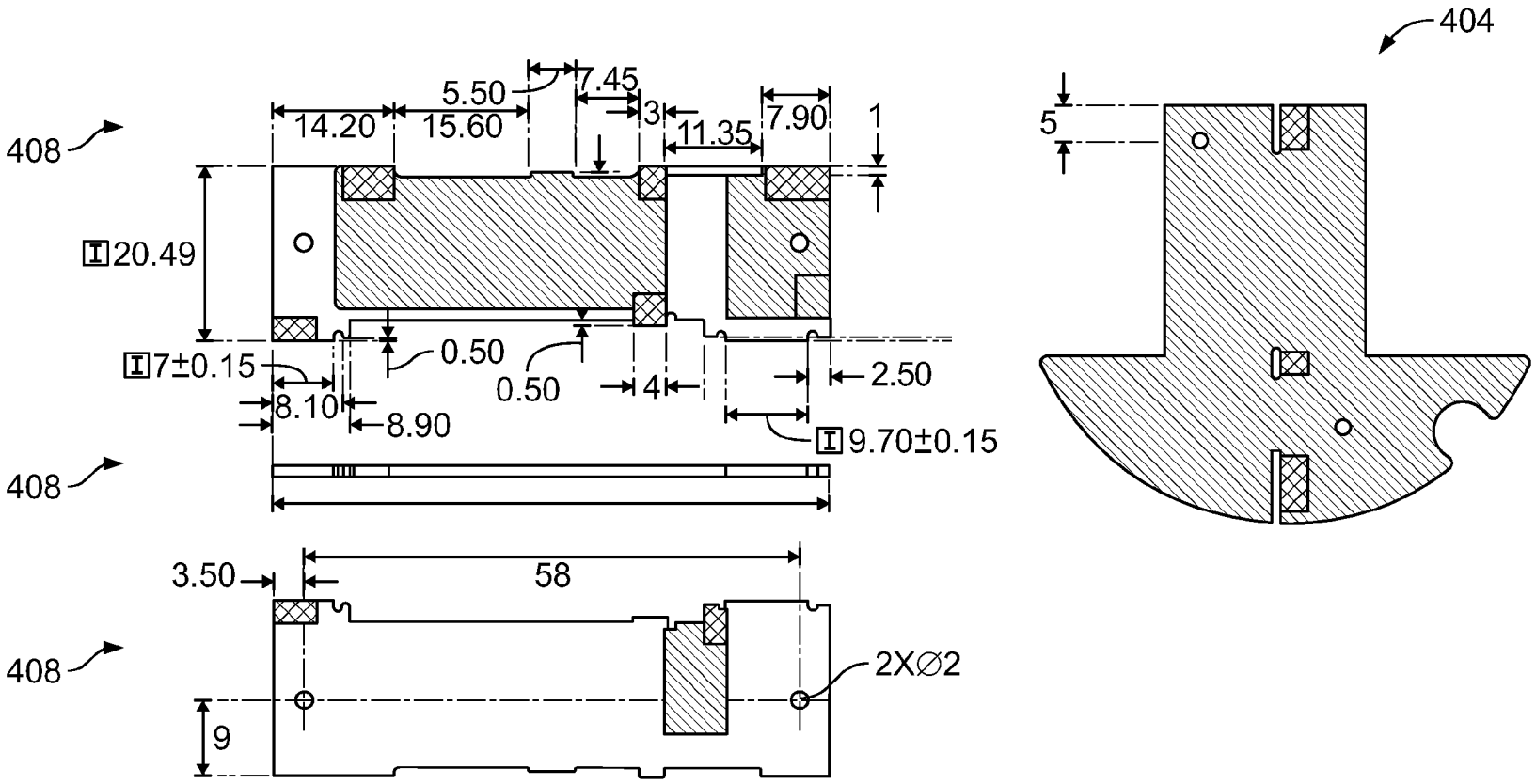
Figure 24:
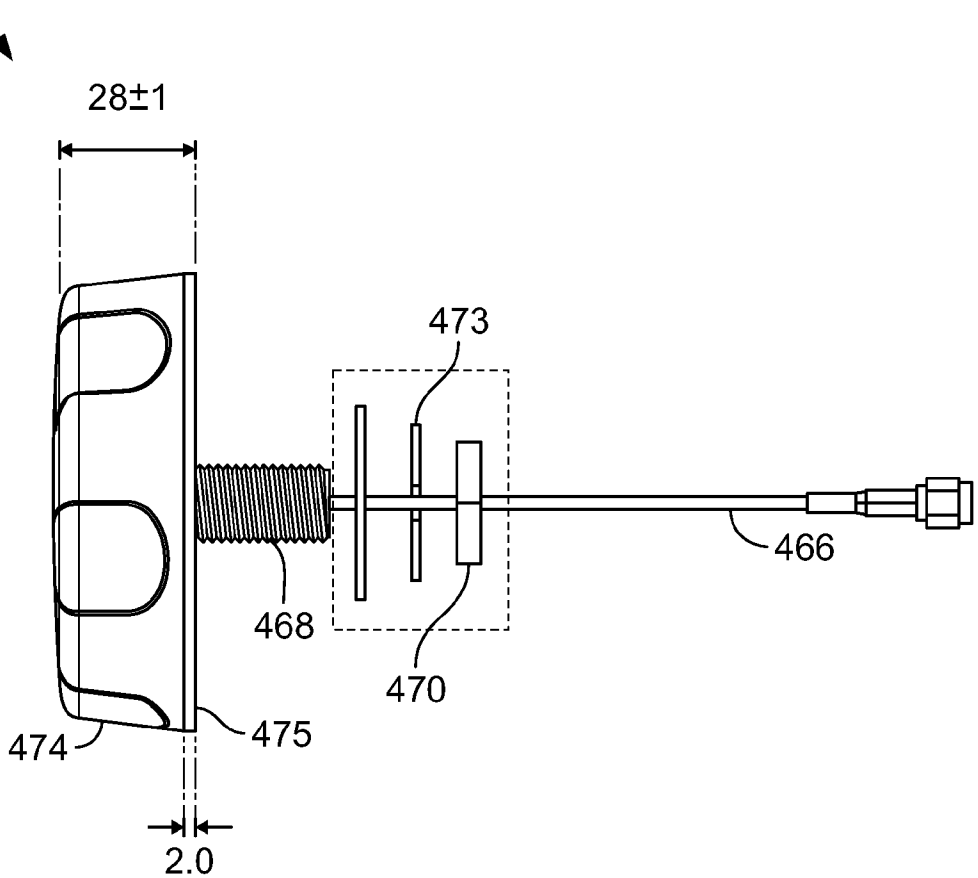
Figure 23:
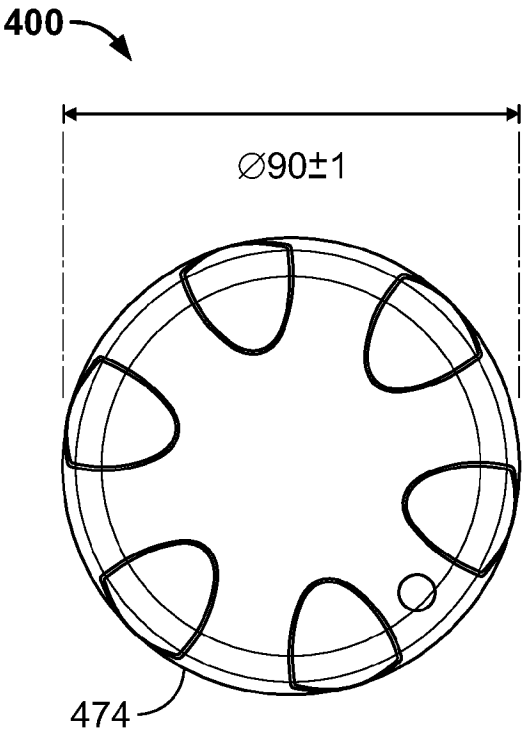
Figure 25:
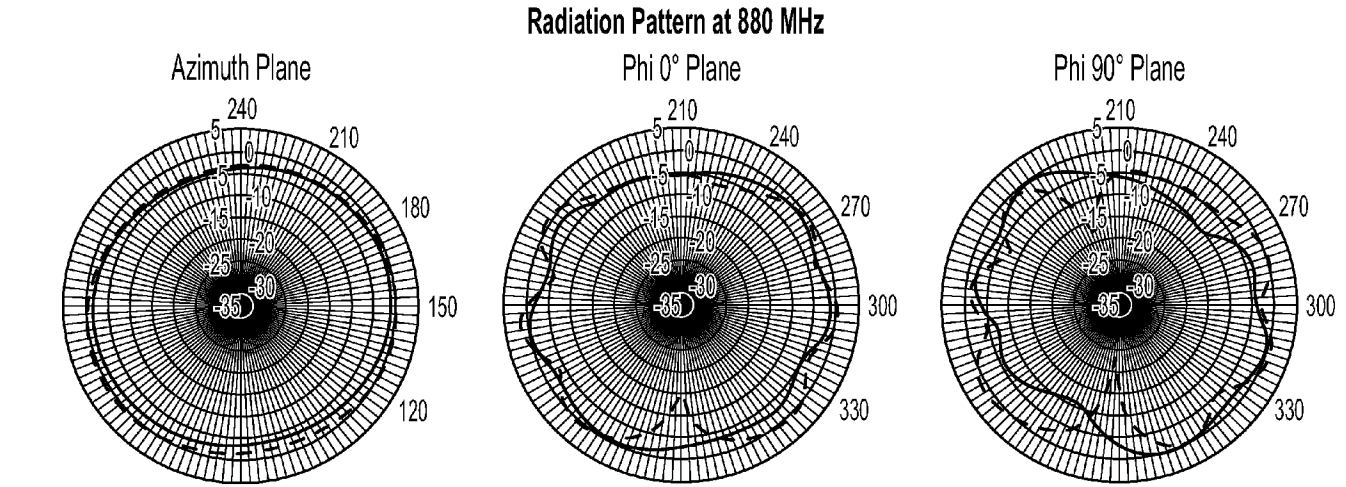
Figure 26:
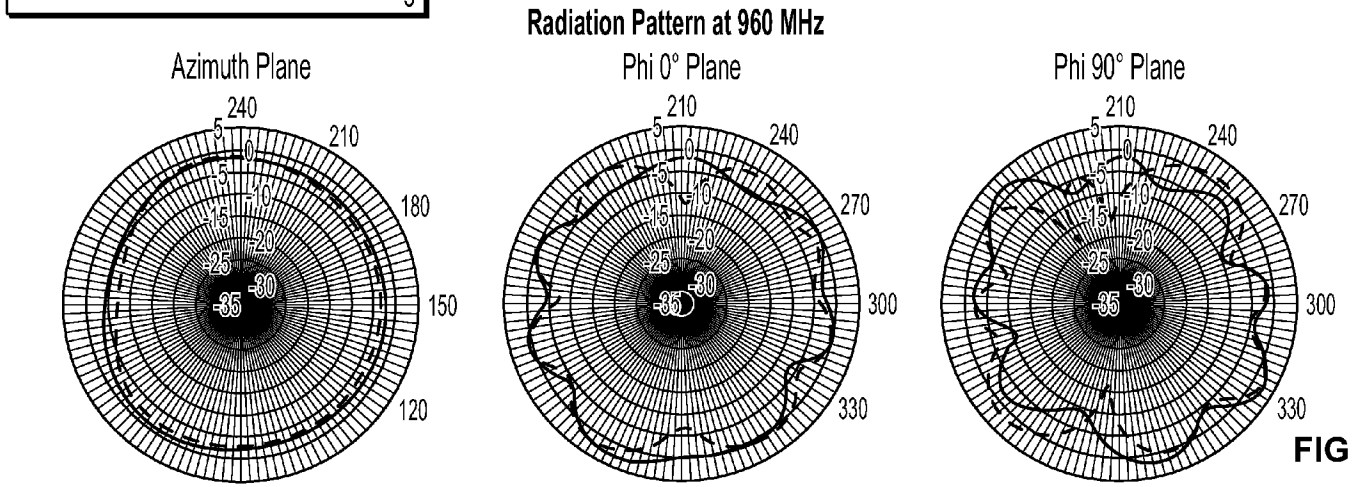
Figure 27:
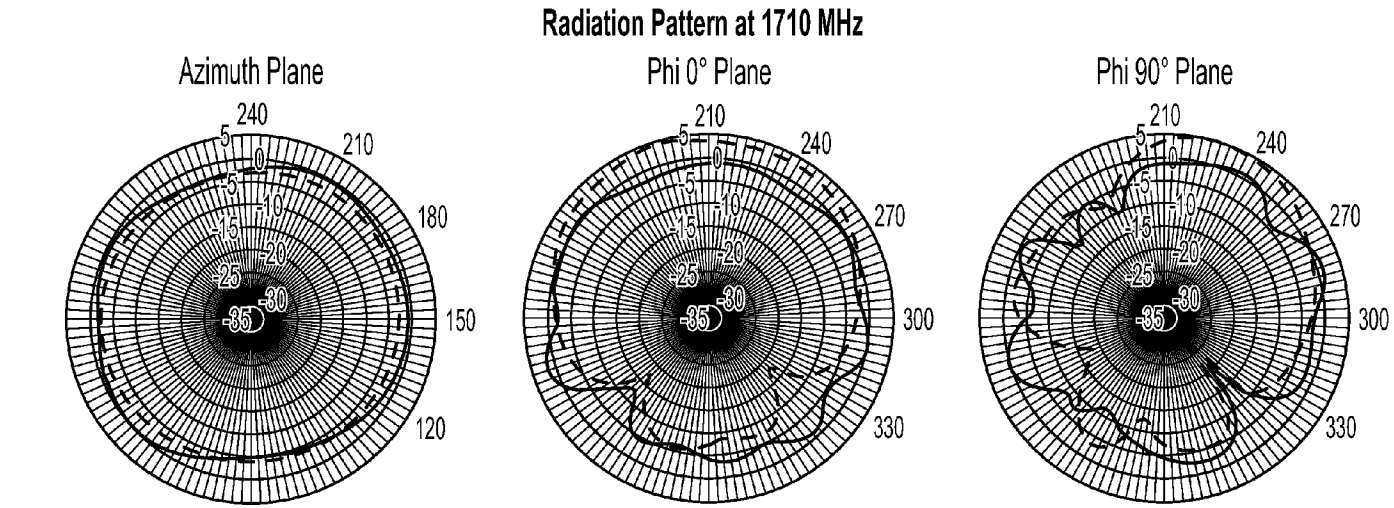
Figure 28:
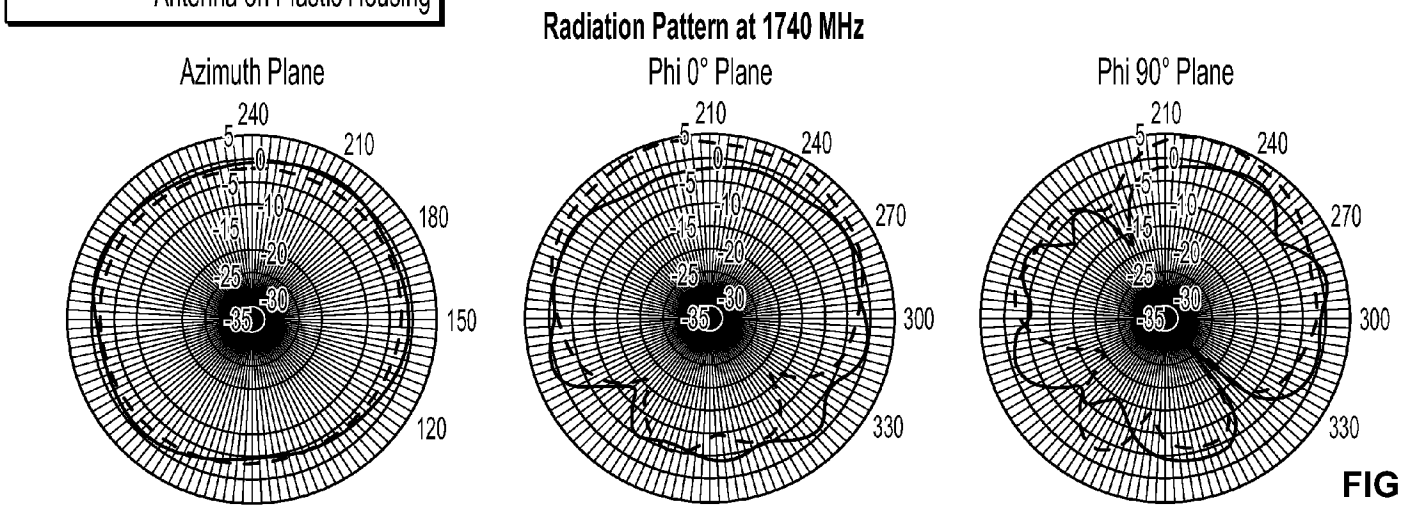
Figure 29:
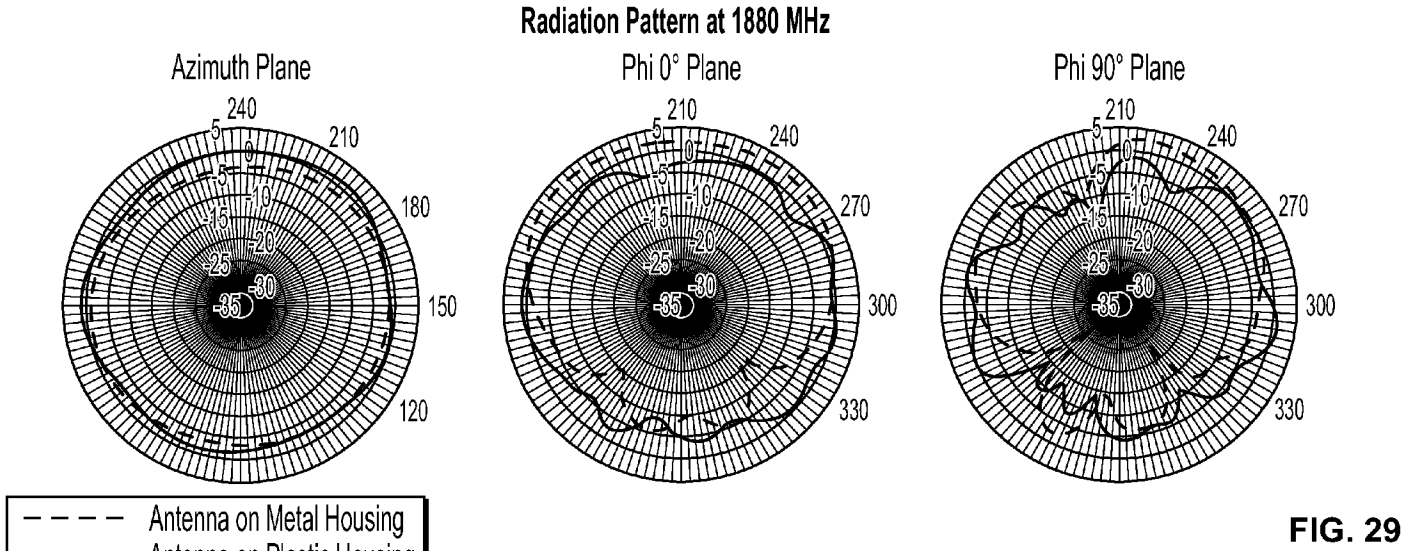
Figure 30:
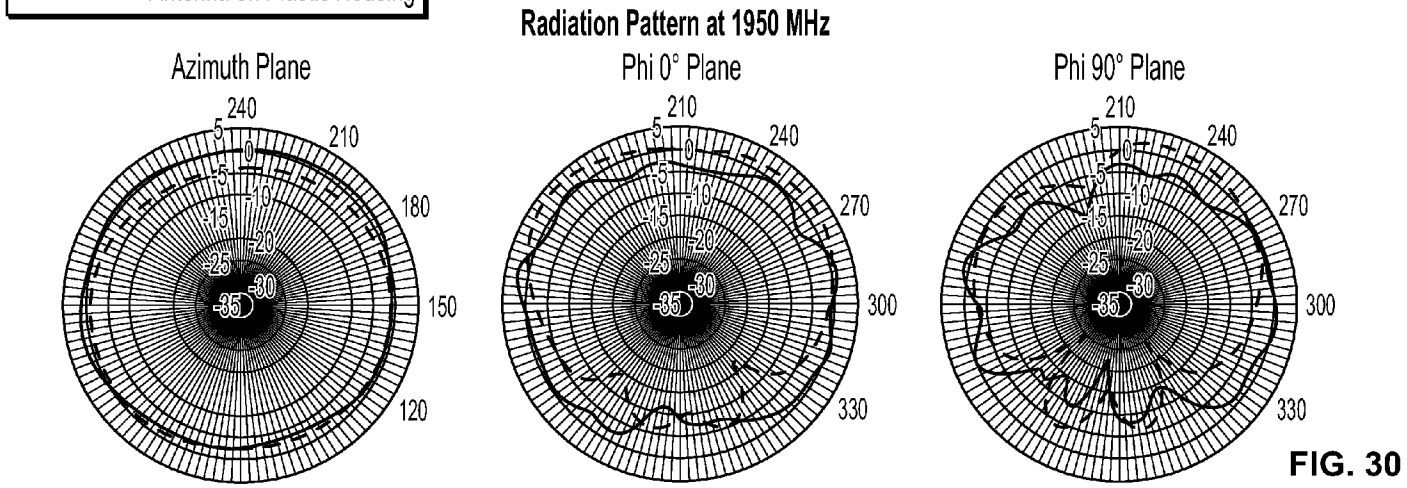
Figure 31:
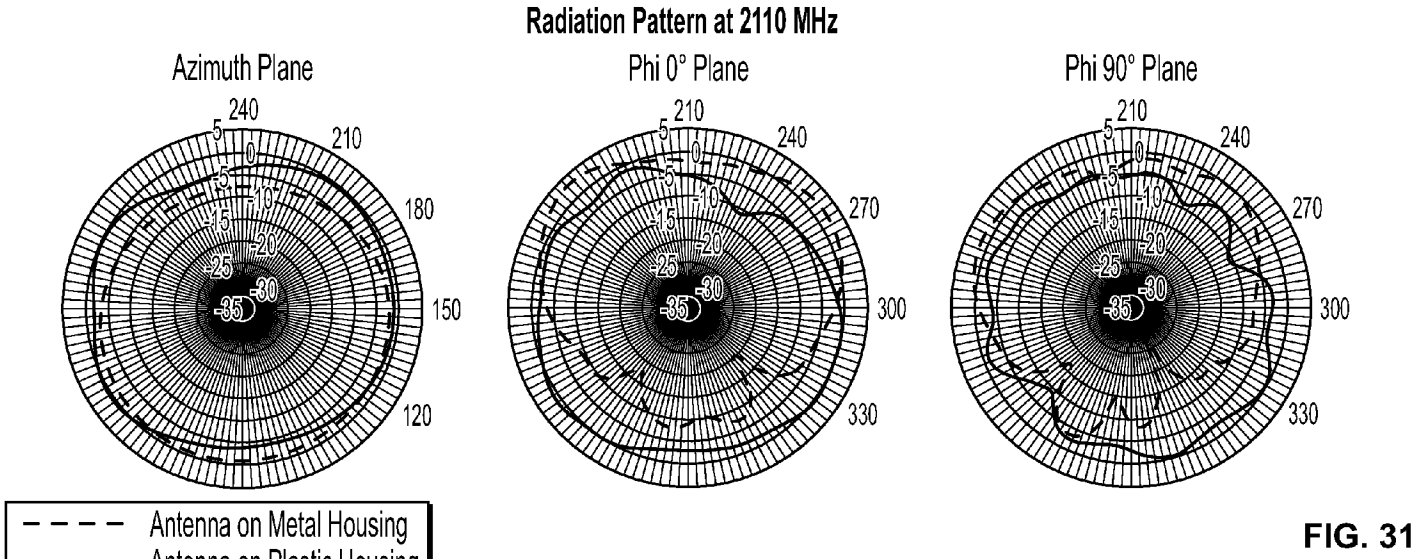
Figure 32:
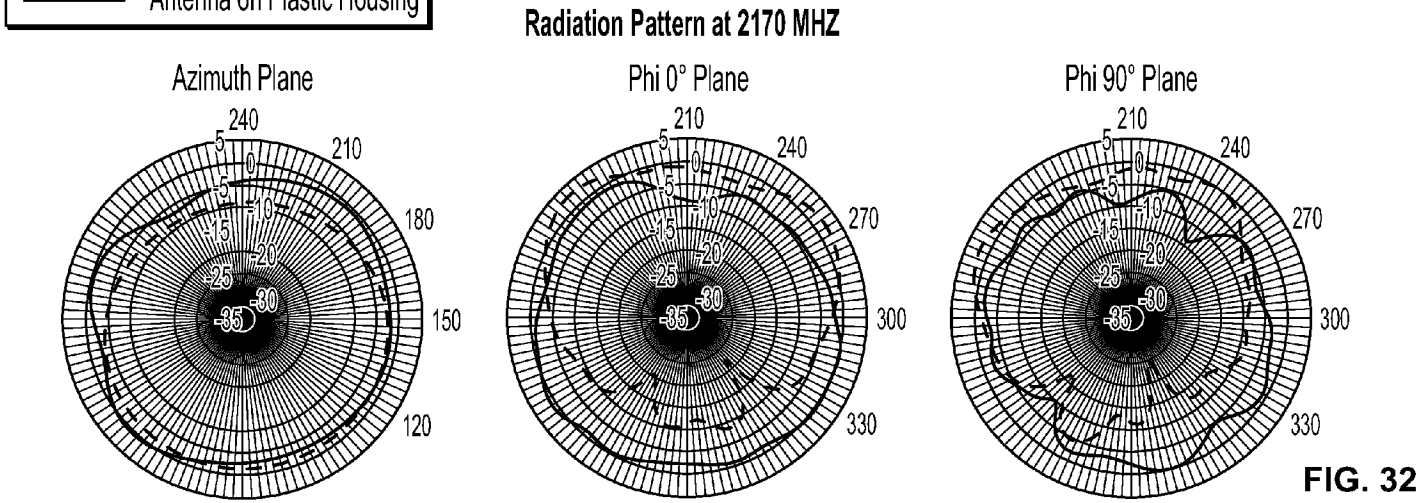

FIG. 21 is an exploded perspective view illustrating the antenna assembly shown in FIG. 20 and also illustrating an exemplary base (e.g., plastic base plate, etc.), antenna mounting member (e.g., electrically conductive threaded portion protruding outwardly from the base, etc.), coaxial cable, and radome aligned to be positioned over the patch element, feed element, high band element, and annular ground and be coupled (e.g., mechanically fastened, etc.) to the base according to an exemplary embodiment;

FIG. 22A illustrates the patch element, high band element, and feed element of the antenna assembly shown in FIGS. 20 and 21;

FIG. 22B illustrates the patch element, high band element, and feeding element shown in FIG. 22A along with exemplary dimensions (in millimeters), which dimensions are provided for purposes of illustration only according to exemplary embodiments;

FIG. 23 is a top view of the radome shown in FIG. 21, where exemplary dimensions (in millimeters) are provided for purposes of illustration only according to exemplary embodiments;

FIG. 24 is a side view of the antenna assembly shown in FIG. 21 after the radome has been positioned over the patch element, feed element, high band element, and annular ground and coupled to the base, where exemplary dimensions (in millimeters) are provided for purposes of illustration only according to exemplary embodiments; and FIGS. 25 through 32 illustrate radiation patterns (Azimuth plane, Phi 0° plane, and Phi 90° plane) measured for a prototype of the antenna assembly shown in FIGS. 20 and 21 on a metal housing and on a plastic housing with the pattern orientation shown in FIG. 13 at frequencies of about 880 MHz, 960 MHz, 1710 MHz, 1740 MHz, 1880 MHz, 1950 MHz, 2110 MHz, and 2170 MHz, respectively.

DETAILED DESCRIPTION

Example embodiments will now be described more fully with reference to the accompanying drawings.

The inventors hereof have recognized that conventional low profile and small antennas used in machine to machine (M2M) and vehicular applications are typically ground dependent and only able to operate at a desired frequency range when used with (e.g., mounted, installed, placed on, etc.) a large ground plane. The ground dependent conventional low profile and small antenna may thus have limited flexibility in terms of application because the antenna may be detuned significantly for different mounting scenarios, e.g., when not used with a large ground plane. The inventors hereof have recognized a need for ground independent multi-band antennas that may be used, for example, with M2M applications where the antenna is mountable or mounted on a plastic chassis or very small ground plane. In such applications, the antennas are preferably low profile and/or have good omnidirectional radiation frequency patterns.

Accordingly, disclosed herein are exemplary embodiments of multi-band antenna assemblies or systems (e.g., 100 (FIG. 1), 400 (FIG. 20), etc.) that are ground independent and have good omnidirectional radiation patterns at multiple frequency bands. In exemplary embodiments, the multi-band antenna assembly is configured to be operable in multiple bands with good omnidirectional radiation patterns whether or not the antenna is mounted on a ground plane. Thus, the multi-band antenna assembly is ground independent and has the flexibility to be operated on a ground plane (e.g., mounted on or to a metal ground plane, etc.) or in a non-ground plane scenario, such as when mounted on or to a dielectric (e.g., plastic, etc.) support surface. In exemplary embodiments, the multi-band antenna assembly may be configured to be operable with good omnidirectional radiation patterns in a first or low cellular frequency band or range (e.g., from about 824 megahertz (MHz) to about 894 MHz, from about 698 MHz to 960 MHz, etc.) and a second or high cellular frequency band or range (e.g., from about 1710 MHz to about 2170 MHz, from about 1710 MHz to 2700 MHz, etc.). Also in exemplary embodiments, the multi-band antenna assemblies may provide multiband features with a single port and/or may be small and low profile. In an exemplary embodiment, an antenna assembly is operable with good omnidirectional radiation patterns in a low band from about 824 MHz to about 894 MHz with a Voltage Standing Wave Ratio (VSWR) of about 3:1 or less and also a high band from about 1710 MHz to about 2170 MHz with a VSWR of about 3:1 or less. Alternative embodiments may be configured differently, e.g., have more than one port, be sized differently, and/or be operable in different frequency ranges, etc.

In an exemplary embodiment, an antenna assembly includes an annular ground plane or element and planar feeding means or element (e.g., printed circuit board (PCB) having a trace thereon, etc.) having a feeding point and shorting point. The antenna assembly also includes an upper or top patch element and one or more high band elements. The high band element (e.g., wings, etc.) may be disposed along or attached to a side edge portion of the planar feeding component. Or, the high band element may be disposed along or adjacent a back of the planar feeding component. For example, the high band element may comprise one or more electrically-conductive traces on the back of the PCB of the planar feeding component. With the annular ground plane, the antenna assembly may be tuned to have a larger bandwidth while also moving or shifting the resonance to a lower frequency. The one or more high band elements are operable for broadening or improving the bandwidth of the high band by means of introducing capacitance to the antenna assembly. The location of the shorting point is closer to a center of the annular ground plane than is the location of the feeding point. The location of the feeding point is closer to an edge of the annular ground plane than is the location of the shorting point. By way of example, the shorting point may preferably be adjacent or located at about or towards the center of the annular ground plane. The feeding point may preferably be adjacent or located at about or towards an edge of the annular ground plane. These locations of the shorting point and feeding point help to ensure that the antenna has a good omnidirectional radiation pattern.

Continuing with this example, the antenna assembly may include a pigtail or coaxial cable grounded adjacent or near the feeding point and routed to the center going through an electrically-conductive (e.g., metal, etc.) mounting member (e.g., threaded stud, threaded stub, or threaded protruding portion, etc.). The mounting member allows the antenna assembly to be mounted to a mounting or support surface (e.g., planar surface, etc.) via one or more locking nuts that are threaded onto the mounting member. If the antenna assembly is mounted to an electrically-conductive (e.g., metal, etc.) external ground plane, the external ground plane is grounded and electrically connected only to the threaded mounting member of the antenna assembly. Though this grounding of the mounting member with the external ground plane may negatively impact omnidirectionality of the antenna assembly, it may also allow the antenna assembly to have broader bandwidth. Depending on the particular application and operating requirements, the antenna assembly may thus be used either on an external electrically-conductive (ground plane) mounting surface or a dielectric (non-ground plane) mounting surface.

Figure 1:
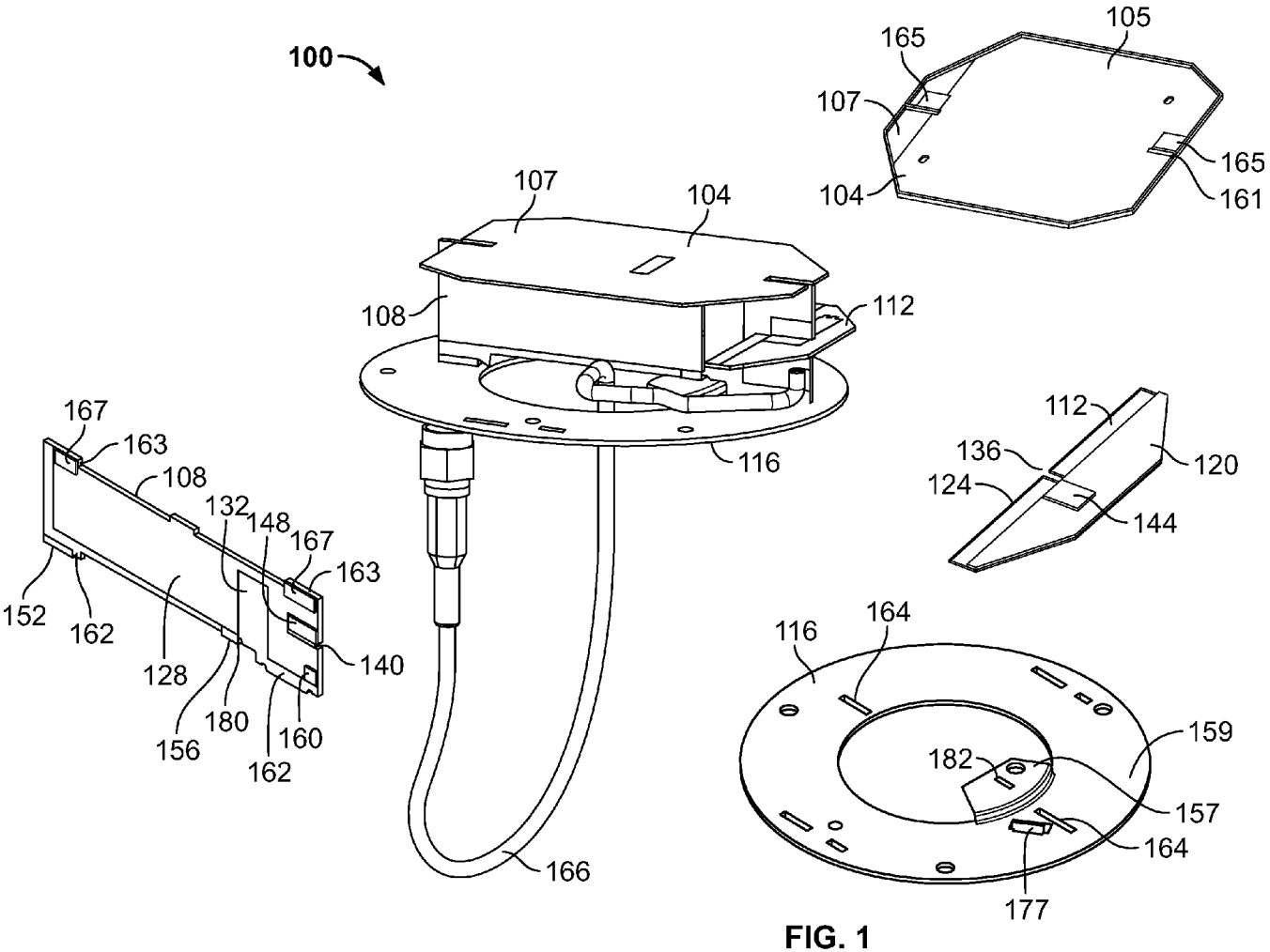
FIG. 1 is a perspective view of a ground independent multi-band antenna assembly according to an exemplary embodiment and also illustrating examples of the patch element, feed element, high band element, and annular ground plane or element.
Figure 2:
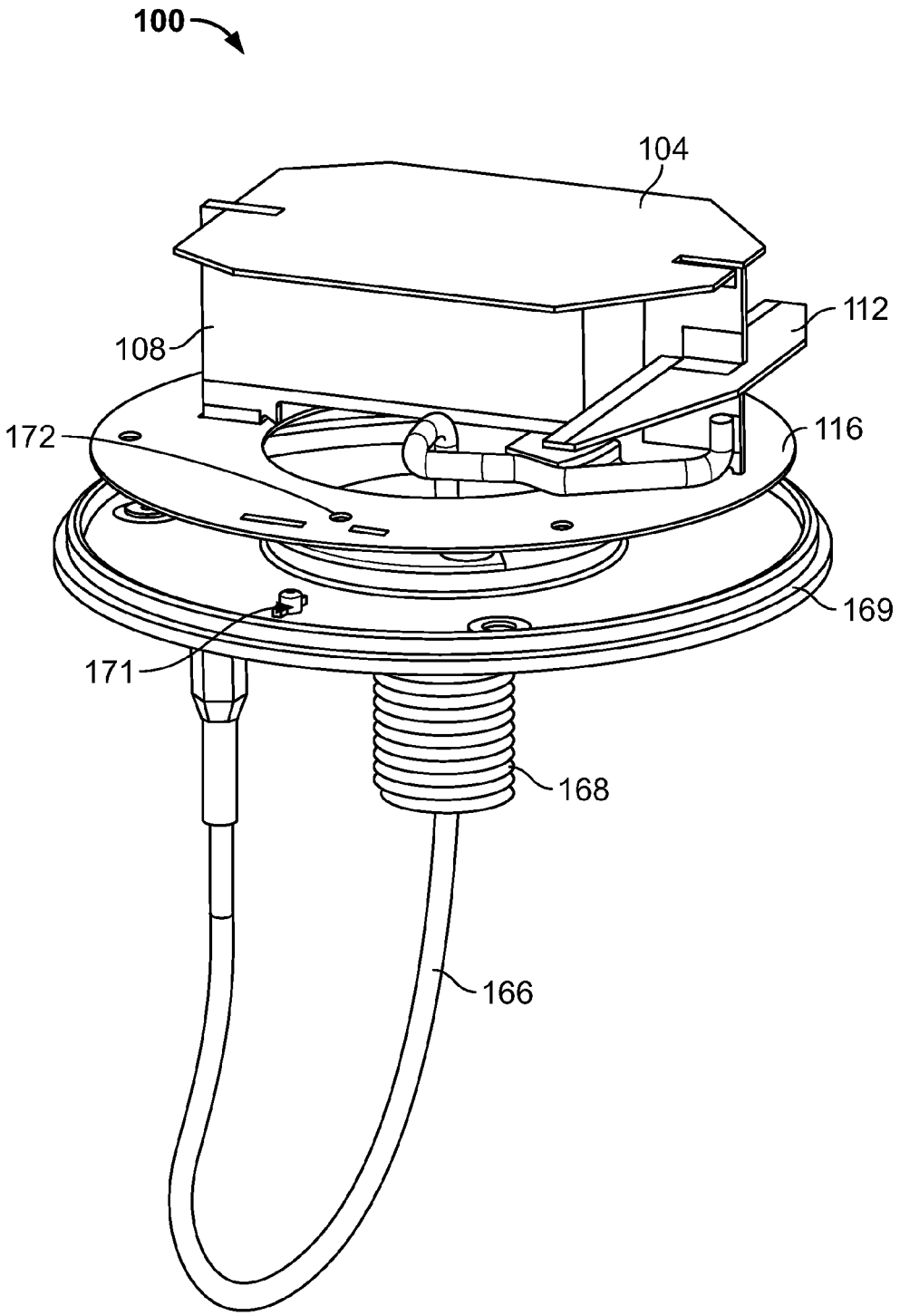
FIG. 2 is an exploded perspective view illustrating the antenna assembly shown in FIG. 1 and also illustrating an exemplary base (e.g., plastic base plate, etc.), antenna mounting member (e.g., electrically conductive threaded portion protruding outwardly from the base, etc.), and coaxial cable according to an exemplary embodiment.
Figure 3:
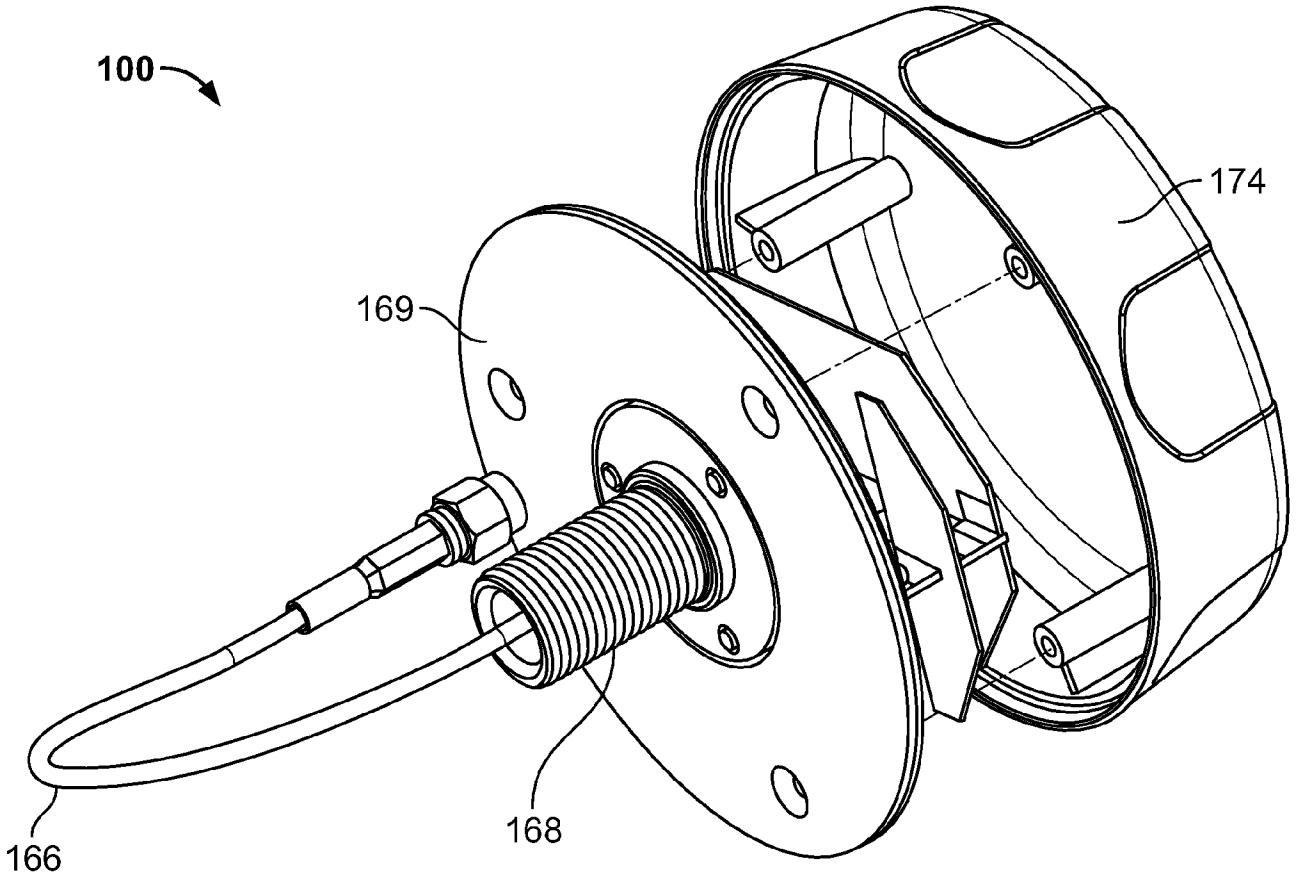
FIG. 3 is an exploded perspective view illustrating the antenna assembly shown in FIG. 2 and also illustrating an exemplary radome aligned to be positioned over the patch element, feed element, high band element, and annular ground plane or element and coupled (e.g., mechanically fastened, etc.) to the base according to an exemplary embodiment.

FIGS. 1 through 3 illustrate an exemplary embodiment of an antenna assembly or system 100 embodying one or more aspects of the present disclosure. As disclosed herein, the antenna system 100 is configured to be ground independent, low profile, and have good omnidirectional radiation patterns in a first or low cellular frequency band or range from about 824 megahertz (MHz) to about 894 MHz and a second or high cellular frequency band or range from about 1710 MHz to about 2170 MHz.

As shown in FIG. 1, the antenna assembly 100 includes a patch element 104, a feeding board 108 (broadly, a feed element), a high band element 112, and an annular ground plane or element 116 (e.g., circular ring shaped ground element, etc.). The patch element 104 is configured to be operable for providing basic resonances for both the low band and the high band. The high band element 112 is configured to be operable as an additional radiating element as well as having capacitance to cancel out inductance of the patch element 104, which is at a higher location. The high band element 112 is operable for improving or broadening the bandwidth of the high band by means of introducing capacitance to the antenna assembly 100.

With the annular ground element 116, the antenna assembly 100 may be tuned to have a larger bandwidth while also moving or shifting the resonance to a lower frequency. The internal diameter of the annular ground element 116 can be adjusted to shift the low frequency band resonance. The annular ground element 116 allows reasonable bandwidth for the low frequency band while also offering omnidirectional radiation pattern to the antenna assembly 100.

In this example, the patch element 104 comprises a radiating element 105 (e.g., electrically-conductive trace or other electrically-conductive material, etc.) on a dielectric substrate 107 (e.g., printed circuit board, etc.). The high band element 112 comprises a radiating element 120 (e.g., electrically-conductive trace or other electrically-conductive material, etc.) on a dielectric substrate 124 (e.g., printed circuit board, etc.). The feed element 108 comprises electrically-conductive material 128 (e.g., electrically-conductive traces, etc.) on a dielectric substrate 132 (e.g., printed circuit board, etc.). In this example, the feeding board 108 is generally rectangular, the high band element 112 is generally hexagonal or wing-shaped, and the patch element 104 is generally octagonal. Also, the patch element 104, the feed element 108, and the high band element 112 have generally flat and planar configurations in this example embodiment. Alternative embodiments may include other radiating means and/or other feeding means (e.g., non-planar, non-flat, differently shaped elements, etc.).

The high band element 112 includes a notch or slot 136 (also shown in FIG. 4A) configured for slidably receiving an edge portion of the feeding board 108. The feeding board 108 also includes a notch or slot 140 configured for slidably receiving an edge portion of the high band element 112. Accordingly, the feeding board 108 and high band element 112 may be aligned relative to each other (e.g., generally perpendicular, etc.) and mechanically coupled together by slidably positioning the high band element 112 relative to the feeding board 108 so that their edge portions are respectively received in the slots 140, 136 of the other one. As shown in FIG. 1, the high band element 112 is disposed along or attached to a side edge portion of the feeding board 108. The high band element 112 may be supported by the feeding board 108 such that the high band element 112 is spaced apart from and generally parallel to the patch element 104 and annular ground element 116.

Figure 4A:
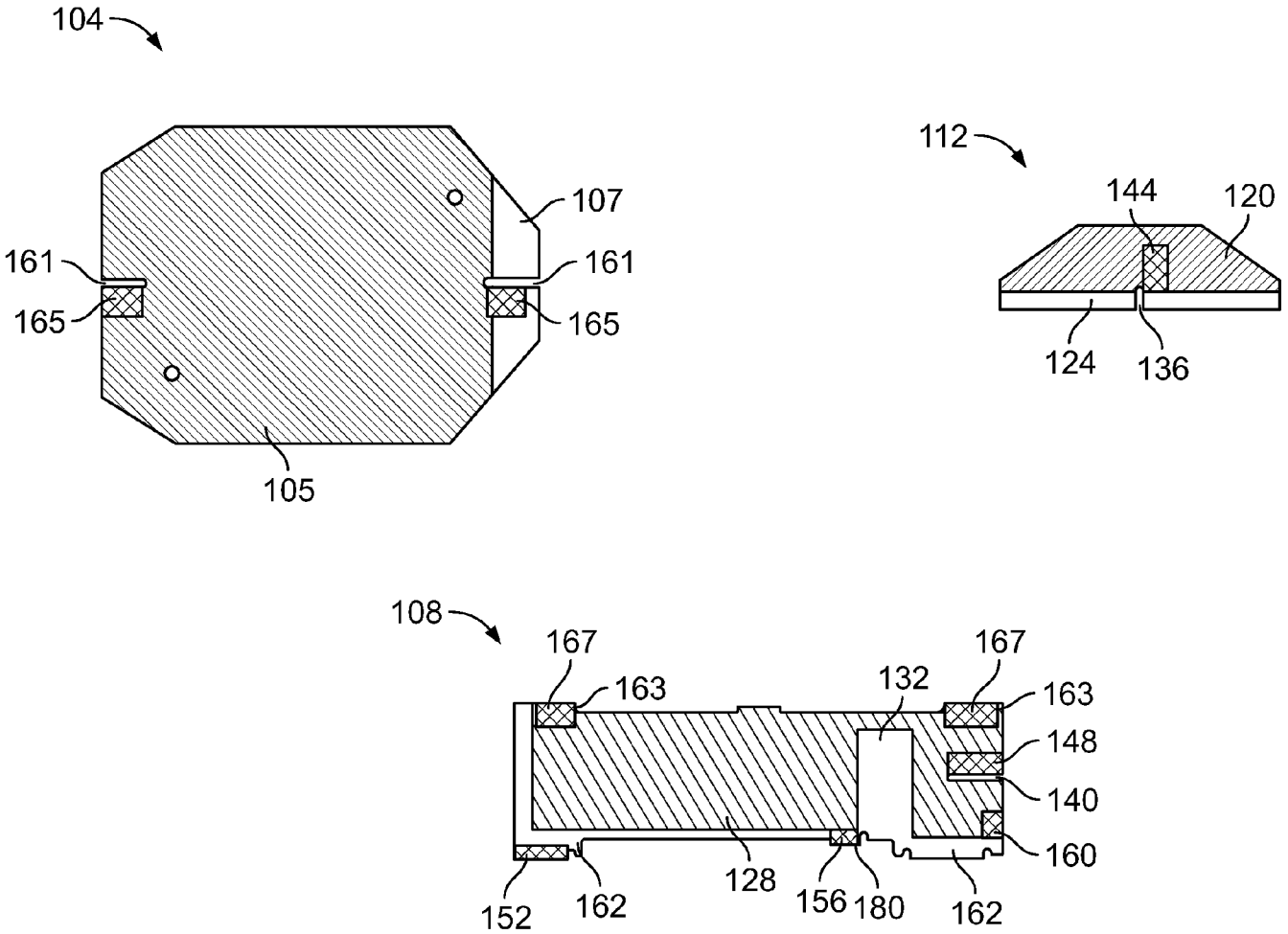
FIG. 4A illustrates the patch element, high band element, and feed element of the antenna assembly shown in FIGS. 1 through 3.

The high band element 112 and feeding board 108 also include respective soldering pads 144 and 148 (also shown in FIG. 4A). As shown in FIG. 1, the soldering pads 144, 148 are aligned and adjacent each other when the high band element 112 and feeding board 108 are mechanically coupled to each via their slots 136, 140. The high band element 112 may be directly coupled electrically (e.g., galvanic electrical connection, etc.) to the feeding board 108 via solder at the solder pads 144, 148. The solder may also help to further mechanically couple or secure the feeding board 108 to the high band element 112. Alternative embodiments may include other means for mechanically and/or electrically coupling a high band element to a feeding component.

Figure 4B:
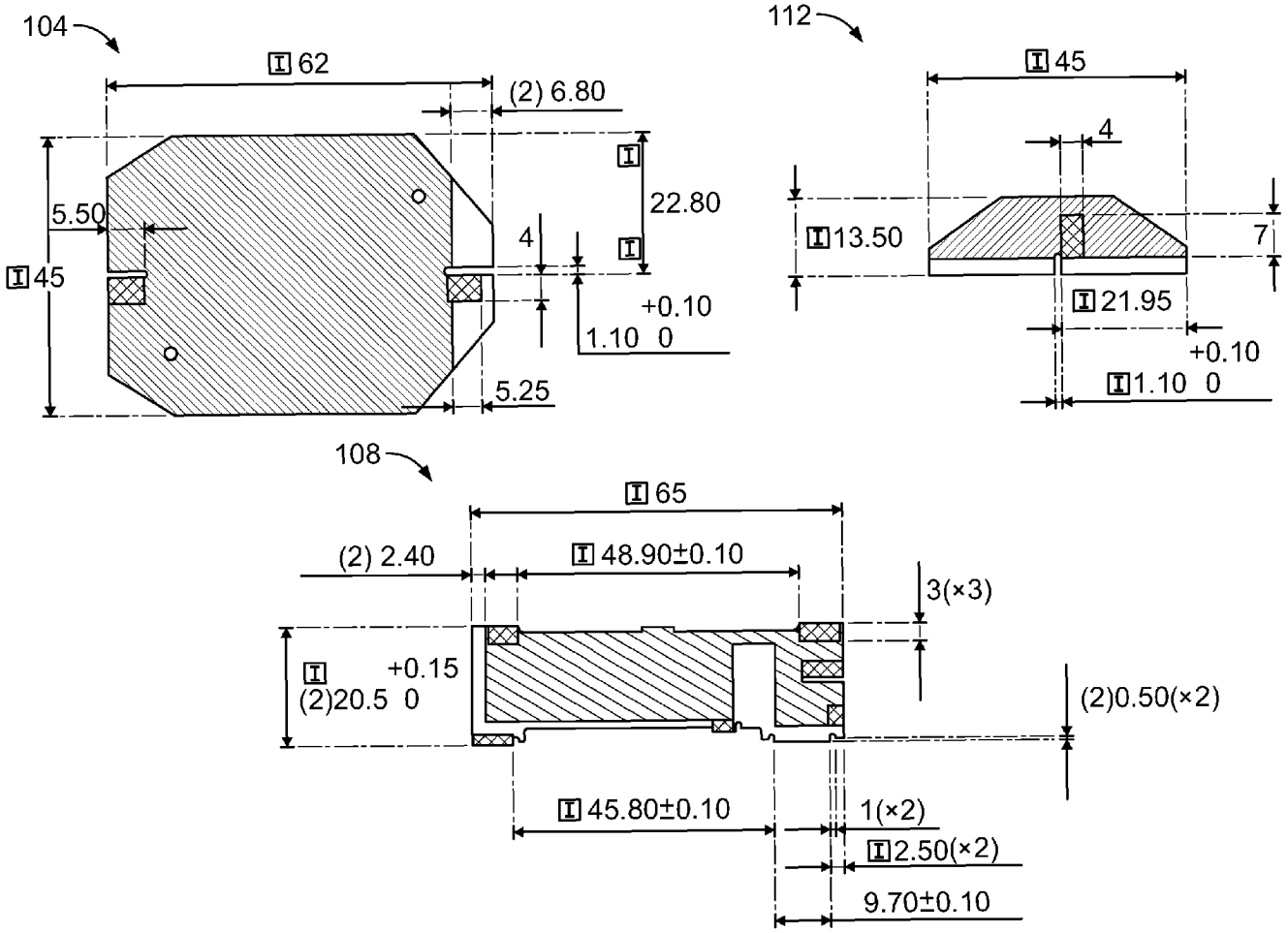
FIG. 4B illustrates the patch element, high band element, and feeding element shown in FIG. 4A along with exemplary dimensions (in millimeters), which dimensions are provided for purposes of illustration only according to exemplary embodiments.

With continued reference to FIGS. 1 and 4, the feeding board 108 also includes a mounting point 152, a shorting point 156, and a feeding point 160. In this example embodiment, the mounting point 152, shorting point 156, and feeding point 160 comprise soldering pads.

The feeding board 108 also includes downwardly extending or protruding portions, projections, or tabs 162 along the bottom of the feeding board 1080. The tabs 162 are configured to be positioned within openings 164 (e.g., holes, slots, etc.) in the annular ground plane 116. The tabs 162 comprise portions of the dielectric substrate 132 of the feeding board 108. The mounting point or solder pad 152 is disposed on one of the tabs 162, which provides an area for soldering the feeding board 108 to the annular ground plane 116. The tabs 162 comprise portions of the feeding board's dielectric substrate 132, which portions do not include the electrically conductive material 128 thereon. As shown in FIG. 4A, the soldering pad 152 is spaced apart from the electrically conductive material of the feeding board. Thus, the solder pad 152 and solder thereon are used to mechanically secure (not electrically connect) the feeding board 108 to the annular ground plane 116. As disclosed herein, the shorting point 156 and solder thereon are used to electrically connect the feeding board 108 to the annular ground plane 116.

The feeding board 108 further includes a downwardly extending or protruding portion, projection, or tab 180 configured to be positioned within an opening 182 (e.g., hole, slot, etc.) in the annular ground plane 116. The shorting point or solder pad 156 is disposed on or defined by the tab 180, which provides an area for soldering and electrically connecting the feeding board 108 to the annular ground plane 116. As shown in FIG. 4A, the soldering pad 156 is adjacent and in contact with the electrically conductive material of the feeding board.

The annular ground plane 116 includes a raised or non-planar portion 157 that is above and thus not co-planar with the annular circular outer portion 159 of the annular ground plane 116. The raised portion 157 includes the opening 182. The positioning of the feeding board's tabs 162 and 180 within the respective openings 164 and 182 of the annular ground plane 116 aligns the feeding board 108 and annular ground plane 116 relative to each other, e.g., generally perpendicular, etc. Accordingly, the feeding board 108 may be electrically connected (e.g., shorted, etc.) to the annular ground plane 116 via solder at the soldering pad 156 and mechanically connected to the annular ground plane 116 via solder at the soldering pad 152 after the tabs 162 and 180 of the feeding board 108 are positioned within the openings 164 and 182 of the annular ground plane 116. The feeding board 108 may thus be supported by (e.g., atop, etc.) the annular ground plane 116 as shown in FIG. 1.

The shorting point 156 is preferably positioned to be adjacent or located at about or towards a center of the annular ground plane 116 when the feeding board 108 is coupled to the annular ground plane 116. The feeding point 160 is preferably positioned to be adjacent or located at about or towards an edge of the annular ground plane 116 when the feeding board 108 is coupled to the annular ground plane 116. Stated differently, the shorting point 156 is preferably closer to a center of the annular ground plane 116 than is the feeding point 160. In turn, the feeding point 160 is closer to an edge of the annular ground plane 116 than is the shorting portion 156. These relative locations of the shorting point 156 and feeding point 160 help ensure that the antenna assembly 100 has good omnidirectional radiation patterns (e.g., FIGS. 14 through 19, etc.).

The patch element 104 includes notches or slots 161 configured for slidably receiving tabs or upwardly protruding portions 163 along a top of the feeding board 108. Accordingly, the patch element 104 and feeding board 108 may be aligned relative to each other (e.g., generally perpendicular, etc.) and mechanically coupled together by slidably positioning the tabs 163 of the feeding board 108 into the slots 161 of the patch element 104.

The patch element 104 and feeding board 108 also include respective soldering pads 165 and 167 (FIGS. 1 and 4). The soldering pads 165, 167 are aligned and adjacent each other when the patch element 104 and feeding board 108 are mechanically coupled to each via the slots 161 and tabs 163. The patch element 104 may be directly coupled electrically (e.g., galvanic electrical connection, etc.) to the feeding board 108 via solder at the solder pads 165, 167. Accordingly, the patch element 104 may thus be electrically connected (shorted) to the annular ground plane 116 via the feeding board 108, which, in turn, is electrically connected to the annular ground plane 116 via solder at the feeding board's shorting point or solder pad 156. The patch element 104 may also be fed via the feeding board 108, which, in turn, is electrically connected to a feed (e.g., coaxial cable 166, etc.) via solder at the feeding board's feeding point or solder pad 160. The solder at the solder pads 165, 167 may also help to further mechanically couple or secure the feeding board 108 to patch element 104. The patch element 104 may be supported by the feeding board 108 such that the patch element 104 is spaced apart from and generally parallel to the high band antenna element 112 and annular ground element 116. Alternative embodiments may include other means for mechanically and/or electrically coupling a patch element to a feeding component.

In addition, the antenna assembly 100 also includes a pigtail or coaxial cable 166 (e.g., RG316 coaxial cable having an SMA connector, etc.). As shown in FIGS. 1 and 2, the coaxial cable 166 is electrically connected to the feeding point 160 of the feeding board 108. The coaxial cable 166 may also be grounded adjacent or near the feeding point 160. For example, an inner conductor of the coaxial cable 166 may be soldered to the soldering pad 160 of the feeding board 108, while an outer braid of the coaxial cable 166 may be soldered to a feature 177 (e.g., cable holder or grounding point, etc.) integrally formed or defined (e.g., stamped, etc.) by the ground plane 116. The coaxial cable 166 is routed from the feeding point 160 and passes through the open center of the annular ground plane 116. The coaxial cable 166 then passes through an electrically-conductive (e.g., aluminum, other metal, etc.) mounting member 168.

The mounting member 168 may comprise a threaded stud or threaded stub (broadly, threaded portion) protruding outwardly from a base 169 (e.g., dielectric base, plastic base, etc.). As shown in FIG. 2, the base 169 includes at least one upwardly protruding portion (e.g., plastic material, etc.) operable as a locating pin 171. The locating pin 171 is configured to be at least partially received within a corresponding opening or hole 172 in the annular ground plane 116 for aligning or locating the annular ground plane 116 in its correct orientation relative to the base 169.

The mounting member 168 allows the antenna assembly 100 to be mounted to a support surface (e.g., planar surface, etc.) via one or more locking nuts 170 (FIG. 5) that are threaded onto the mounting member 168. A washer 173 may also be positioned on the mounting member 168 between the locking nut 170 and a sealing member or gasket 175. By way of example, the antenna assembly 100 may be mounted to a ceiling by positioning the base 169 on one side of the ceiling and positioning and threading the locking nut 170 onto the threaded portion 168 on the opposite side of the ceiling. Accordingly, this exemplary embodiment of the antenna assembly 100 is operable in multiple frequency bands with a single port. Alternative embodiments may include other feeding arrangements or means for feeding the antenna assembly besides coaxial cables (e.g., transmission lines, have more than a single port, etc.) and/or other mounting arrangements or means besides an aluminum threaded stud.

If the antenna assembly 100 is mounted to an electrically-conductive (e.g., metal, etc.) external ground plane, the external ground plane is grounded and electrically connected only to the threaded mounting member 168 of the antenna assembly 100. Though this grounding of the mounting member 168 with the external ground plane may reduce omnidirectionality at the highest frequency band edge of the antenna assembly 100, it may also allow the antenna assembly 100 to have broader bandwidth. Depending on the particular application and operating requirements, the antenna assembly 100 may thus be used either on an external electrically-conductive (ground plane) mounting surface or a dielectric (non-ground plane) mounting surface.

As shown in FIG. 3, the antenna assembly 100 may also include a radome or housing 174 (e.g., plastic molded radome having a generally hockey puck shape, etc.). The radome 174 may be positioned over the patch element 104, feeding board 108, high band element 112, and annular ground plane 116 and then be coupled (e.g., mechanically fastened, etc.) to the base 169. By way of example only, the radome 174 may have a diameter of about 90 millimeters and a height of about 26 millimeters. But these dimensions (as are all dimensions disclosed herein) are only examples as other embodiments may be dimensionally sized larger or smaller.

Figure 5:
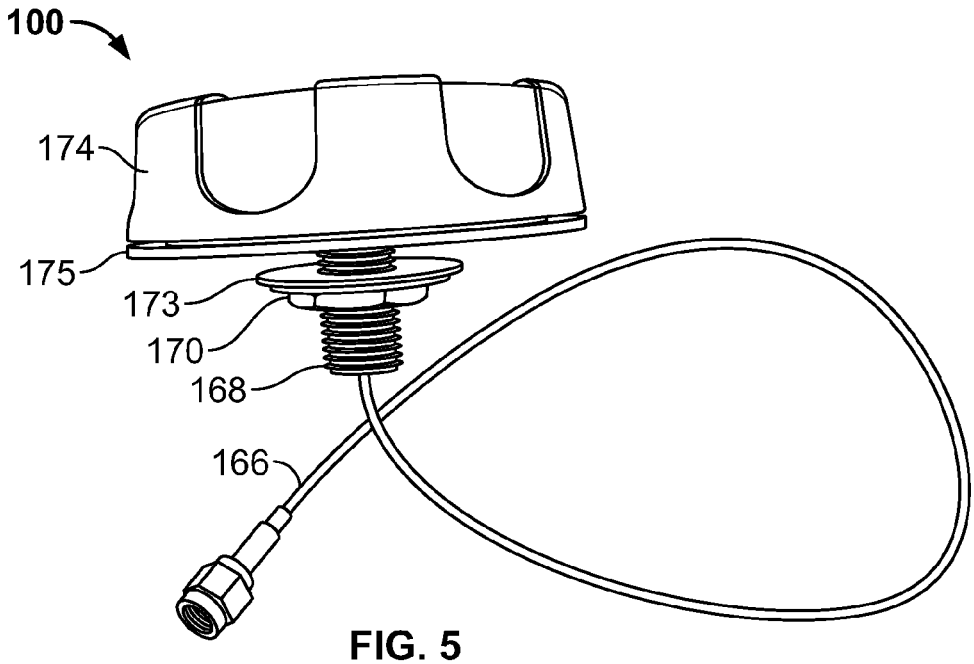
FIG. 5 shows a prototype including the antenna assembly shown in FIGS. 1 through 3 according to exemplary embodiments.
Figure 6:
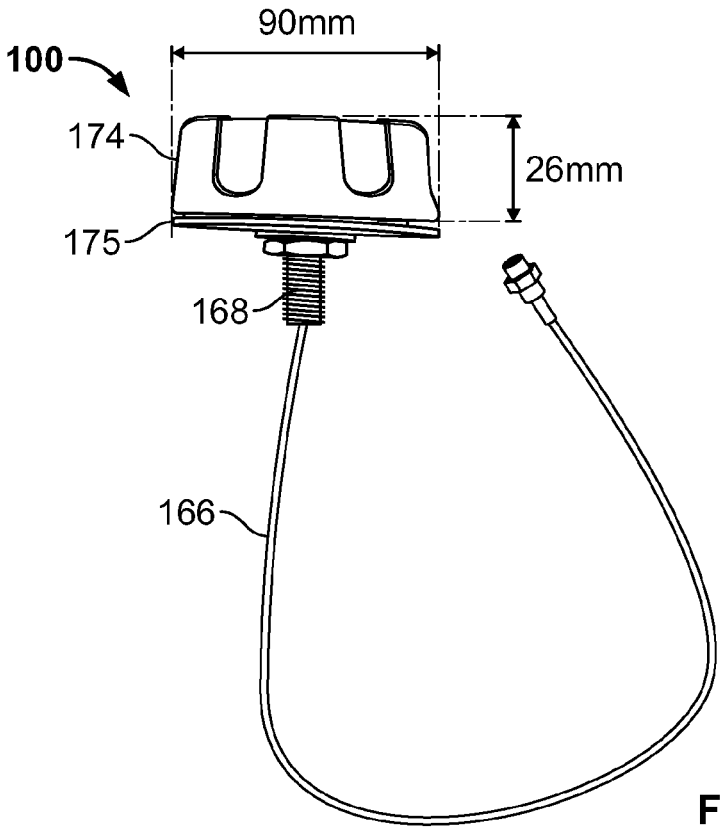
FIG. 6 shows the prototype antenna of FIG. 5, where exemplary dimensions (in millimeters) are provided for purposes of illustration only according to exemplary embodiments.
Figure 7:
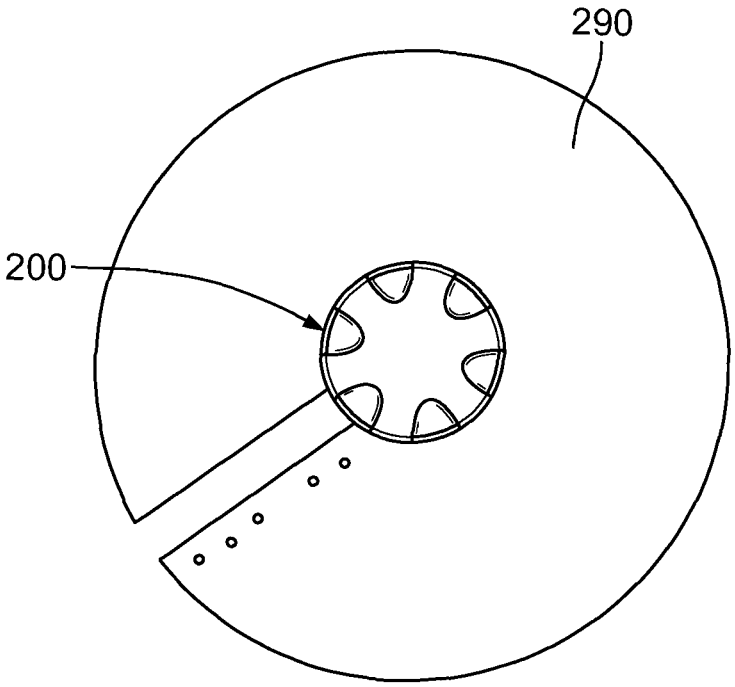
FIG. 7 shows the prototype antenna of FIG. 5 attached onto a circular metal ground plane having a diameter of 30 centimeters (cm) where this specific ground plane and dimension thereof was used for testing purposes and not for purposes of limitation.

FIGS. 5 and 6 show an example prototype that includes the antenna assembly 100 shown in FIGS. 1 through 3, where the shorted patch element 104, feeding board 108, and high band element 112 were configured (e.g., dimensionally sized, shaped, etc.) as shown in FIG. 4A. In this example, the prototype antenna 100 was operable in a low band from about 824 MHz to about 894 MHz and a high band from about 1710 MHz to about 2170 MHz. The antenna 100 was RoHS compliant and had a VSWR of 3:1 or less and nominal impedance of 50 ohms. The antenna 100 also had a linear polarization and produced omnidirectional radiation patterns (as shown in FIGS. 14 through 19). The prototype antenna 100 had a diameter of 90 millimeters and a height of 26 millimeters as shown in FIG. 6. Gain and efficiency were measured for the prototype antenna 100 when the antenna 200 was at a center of a metal ground plane 290 (FIG. 7) having a diameter of 30 centimeters and when the antenna 300 was on a plastic casing 392 (FIG. 8) having dimensions of 255 mm×255 mm×2.2 mm. An RG316 (2 foot long) cable terminated with an SMA connector used during the testing. The antenna 200 on the metal ground plane 290 had a maximum gain of 2.39 dBi and average efficiency of 62% for the 824-894 MHz low band, and a maximum gain of 5.48 dBi and average efficiency of 68% for the 1710-2170 MHz high band. The antenna 300 on the plastic casing 392 had a maximum gain of 1.86 dBi and average efficiency of 63% for the 824-894 MHz low band, and a maximum gain of 3.42 dBi and average efficiency of 64% for the 1710-2170 MHz high band. The above operating characteristics and dimensions are provided for purposes of illustration only as other exemplary embodiments may be configured differently, e.g., have different operating characteristics, be sized smaller or larger, etc.

Figure 8:
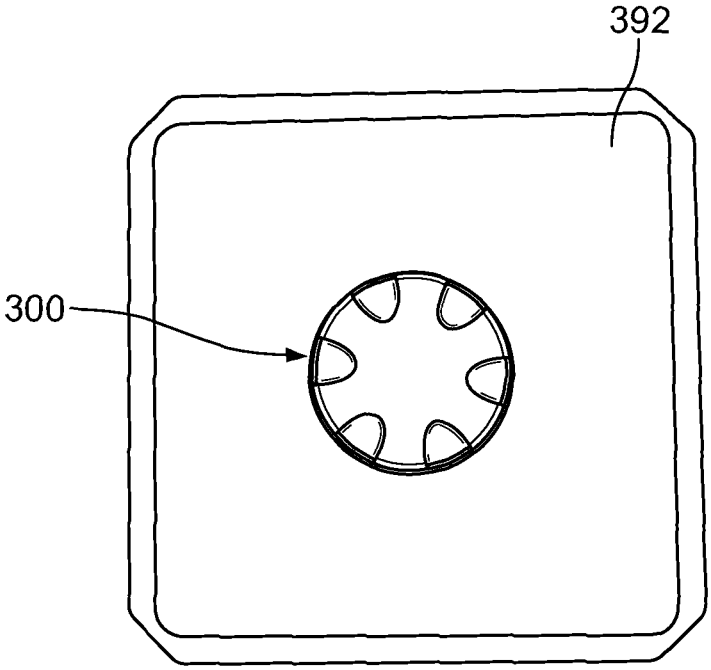
FIG. 8 shows the prototype antenna of FIG. 5 attached onto a square plastic casing having a width of 255 millimeters (mm), a length of 255 mm, and thickness of 2.2 mm, where this plastic casing and dimensions thereof was used for testing purposes and not for purposes of limitation.

FIGS. 9 through 22 provide the results measured for the prototype antennas 200, 300 when respectively mounted on a metal ground plane 290 (FIG. 7) and a plastic casing 392 (FIG. 8). These analysis results are provided only for purposes of illustration and not for purposes of limitation.

Figure 9:
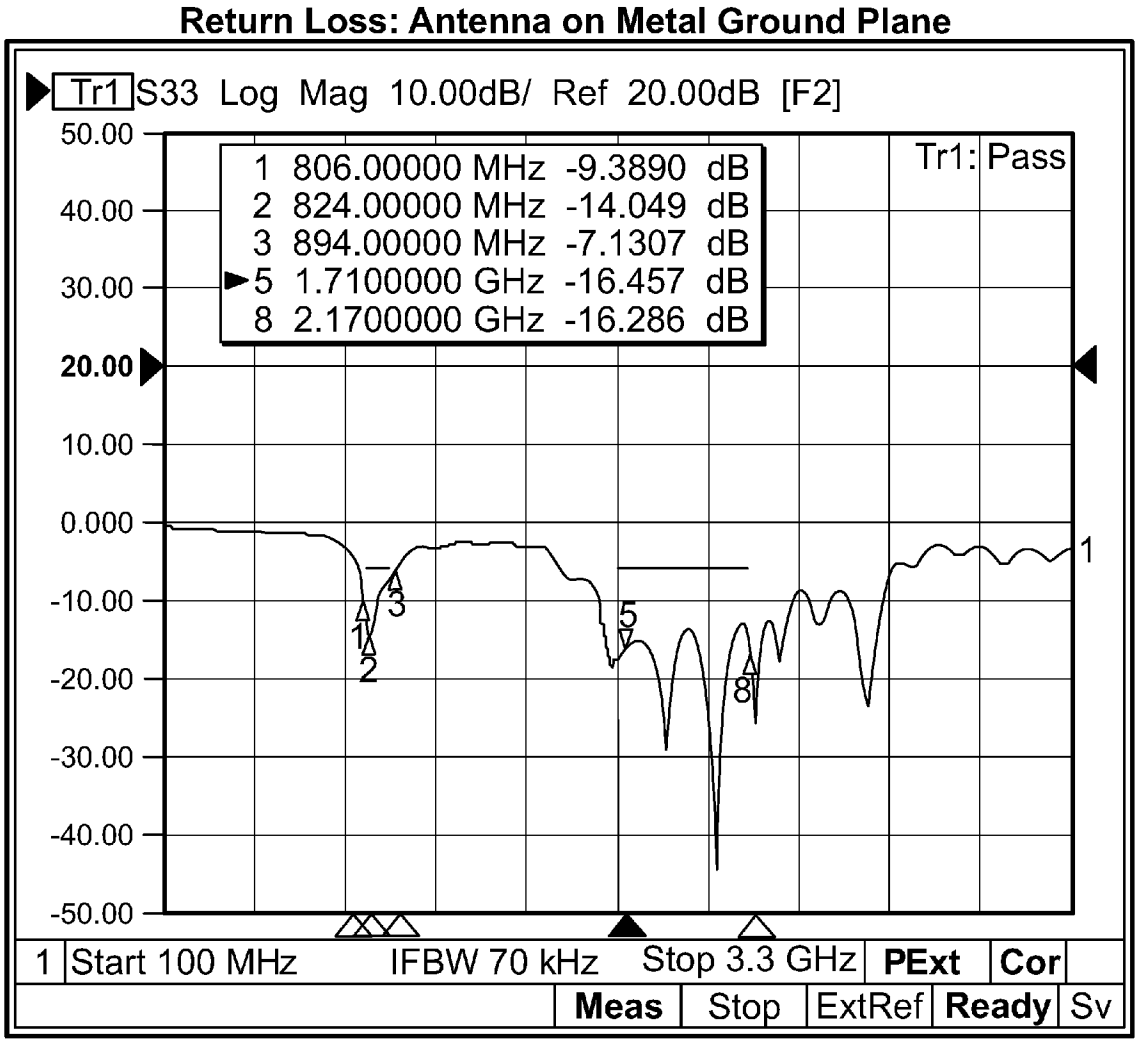
FIG. 9 is an exemplary line graph of return loss in decibels (dB) versus frequency measured for the prototype antenna on the metal ground plane shown in FIG. 7.
Figure 10:
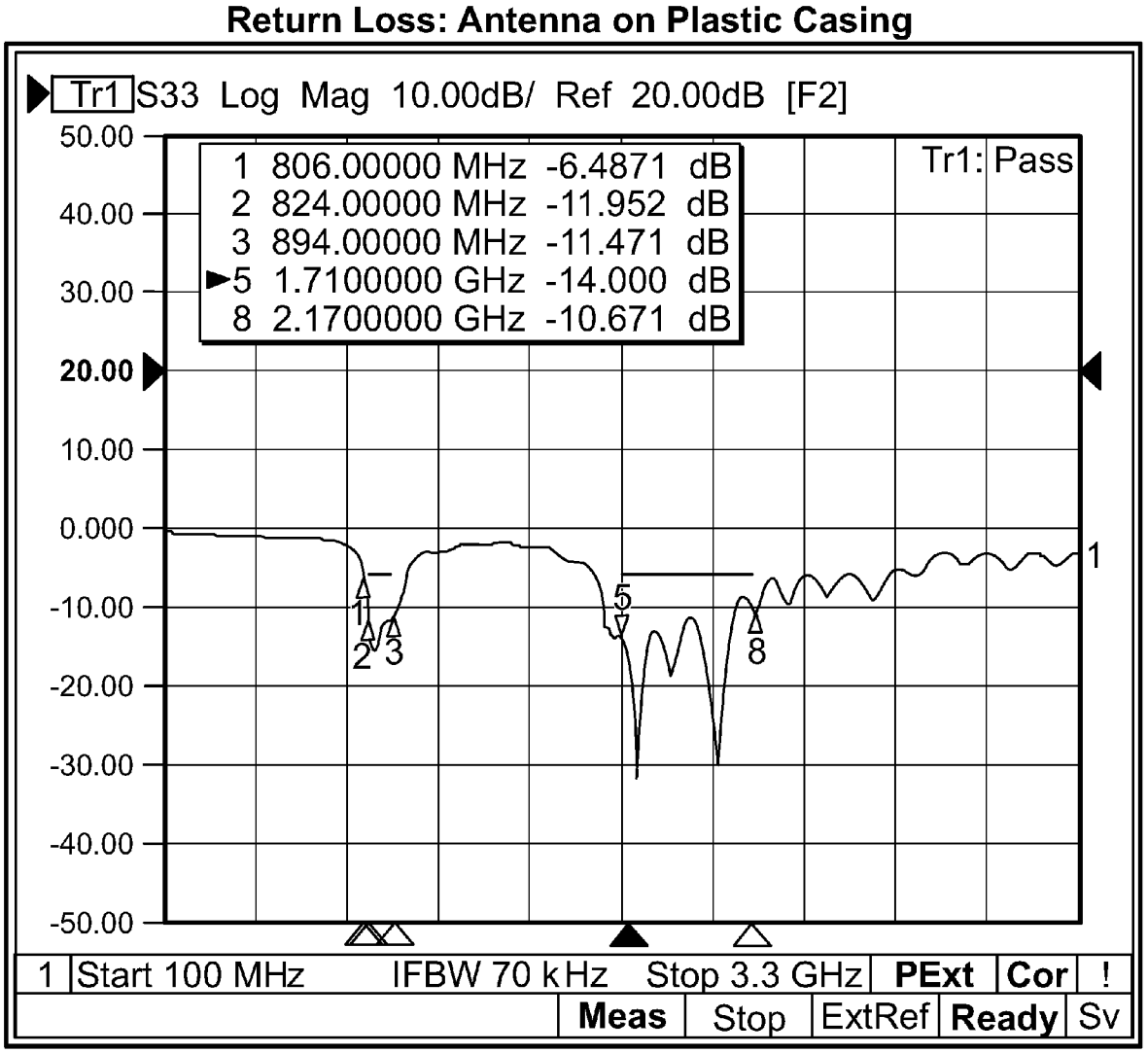
FIG. 10 is an exemplary line graph of return loss in decibels (dB) versus frequency measured for the prototype antenna on the plastic casing shown in FIG. 8.
Figure 11:
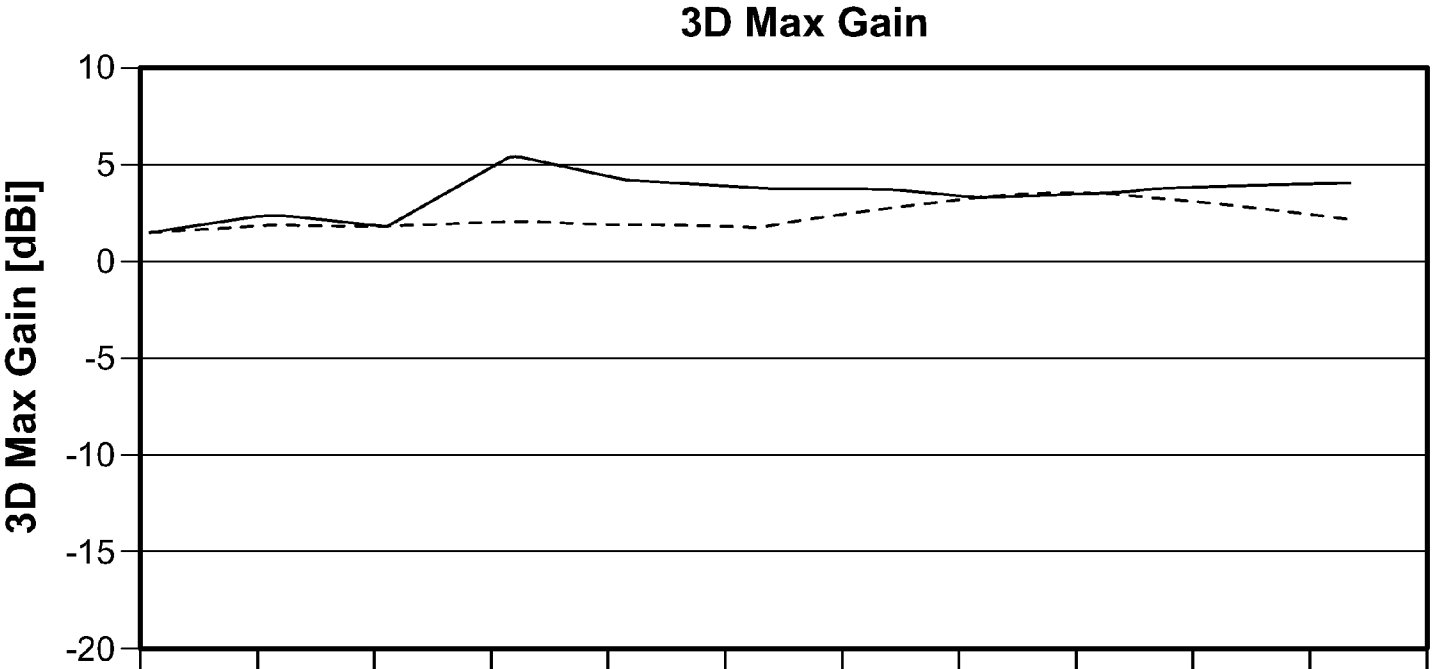
FIG. 11 is an exemplary line graph of 3D Max Gain in decibels isotropic (dBi) versus frequency measured for the prototype antenna on the metal ground plane (FIG. 7) and on the plastic casing (FIG. 8)
Figure 12:
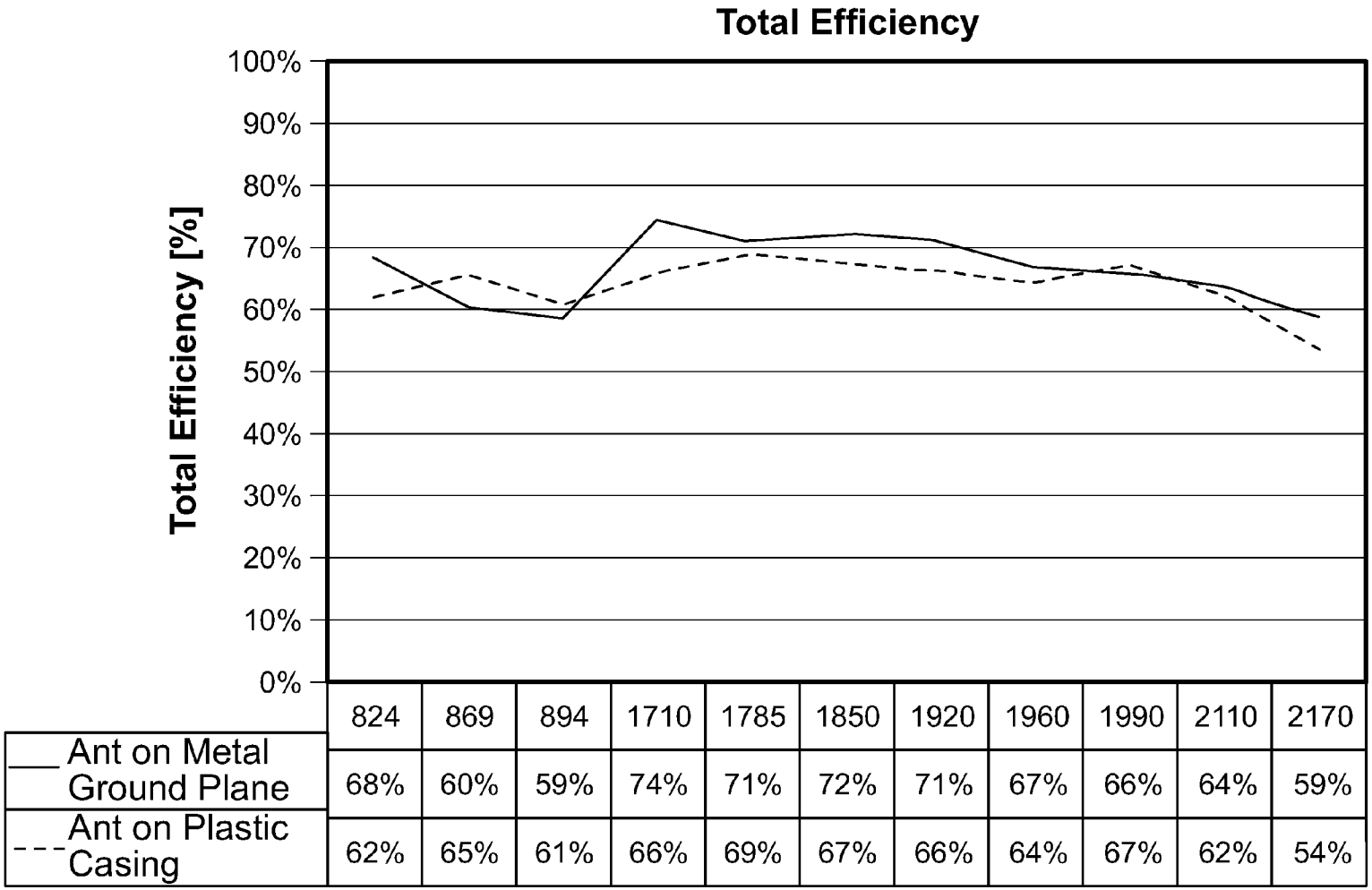
FIG. 12 is an exemplary line graph of total efficiency (%) versus frequency measured for the prototype antenna on the metal ground plane (FIG. 7) and on the plastic casing (FIG. 8)

More specifically, FIGS. 9 and 10 are exemplary line graphs of return loss in decibels (dB) versus frequency measured respectively for the prototype antenna 200 on the metal ground plane 290 (FIG. 7) and prototype antenna 300 on the plastic casing 392 (FIG. 8). FIG. 11 is an exemplary line graph of 3D Max Gain in decibels isotropic (dBi) versus frequency measured for the prototype antennas 200 and 300. FIG. 12 is an exemplary line graph of total efficiency (%) versus frequency measured for the prototype antennas 200 and 300. Generally, FIGS. 9 through 12 shows that the antenna assembly 100 is operable with is operable with the antenna performance characteristic in terms of return loss, gain, and efficiency at low band and high band when mounted on a ground plane (e.g., metal ground plane, etc.) and when mounted on a non-ground plane (e.g., a plastic casing, etc.). Generally, the antenna assembly 100 meets the common VSWR specification <3:1 and with reasonable gain and good efficiency performance.

FIGS. 14 through 19 illustrate radiation patterns (Azimuth plane, Phi 0° plane, and Phi 90° plane) measured for the prototype antennas 200 and 300 on a metal ground plane (FIG. 7) and a plastic casing (FIG. 8), respectively, with the pattern orientation shown in FIG. 13 at frequencies of about 824 MHz, 894 MHz, 1710 MHz, 1850 MHz, 1990 MHz, and 2170 MHz, respectively. Generally, FIGS. 14 through 19 show that the antenna assembly 100 has good omnidirectional radiation patterns at both low band and high band when mounted on a ground plane and when mounted on a non-ground plane (e.g., a plastic casing, etc.).

Accordingly, the antenna assembly 100 is ground independent such that the antenna assembly 100 does not depend on or have to be used with a separate, external, or additional ground plane, such as an electrically-conductive (e.g., metal, etc.) mounting surface, etc. For example, the antenna assembly 100 may provide good omnidirectional radiation patterns at multiple frequency bands while using only its own internal annular ground plane 116 and without any additional external ground plane. The antenna assembly 100 may also provide good omnidirectional radiation patterns at multiple frequency bands when mounted to an additional external ground plane. The antenna assembly 100 has good omnidirectional radiation patterns at multiple frequency bands regardless of whether or not the antenna assembly 100 is mounted on a ground plane, thereby providing flexibility for different antenna mounting scenarios.

Immediately below are Tables 1 and 2 with performance summary data measured for the prototype antennas 200 and 300 on a metal ground plane 290 (FIG. 7) and a plastic casing 392 (FIG. 8), respectively. As shown by Tables 1 and 2 below, the prototype antenna system 200 has good efficiency and gain when on the metal ground plane (Table 1) or the plastic casing (Table 2) for both the low band from 824 MHz to 849 MHz and the high band from 1710 MHz to 2170 MHz for Machine to Machine (M2M) or vehicular applications.

TABLE 1

(Antenna on Metal Ground Plane)

| | 3D | | Azimuth | | Elevation 0° | | Elevation 90° | |
|---|---|---|---|---|---|---|---|---|
| Frequency (MHz) | Efficiency | Max Gain | Max Gain | Average Gain | Max Gain | Average Gain | Max Gain | Average Gain |
| 824 | 68% | 1.50 | 1.17 | −1.36 | 1.49 | −1.97 | 0.23 | −2.81 |
| 869 | 60% | 2.39 | −0.03 | −3.11 | 2.31 | −2.14 | −0.71 | −3.49 |
| 894 | 59% | 1.86 | −0.82 | −4.16 | 1.86 | −2.33 | 0.29 | −3.62 |
| 1710 | 74% | 5.48 | −0.72 | −2.55 | 5.02 | −0.70 | 5.22 | −0.82 |
| 1785 | 71% | 4.17 | −1.17 | −2.90 | 4.13 | −1.04 | 3.99 | −1.26 |
| 1850 | 72% | 3.76 | −0.98 | −2.61 | 3.69 | −0.97 | 3.62 | −1.36 |
| 1920 | 71% | 3.63 | −0.74 | −2.88 | 2.86 | −1.22 | 3.03 | −1.62 |
| 1960 | 67% | 3.28 | −0.72 | −2.71 | 2.32 | −1.46 | 2.52 | −1.99 |
| 1990 | 66% | 3.59 | −1.16 | −3.21 | 2.52 | −1.51 | 2.15 | −2.08 |
| 2110 | 64% | 3.84 | −0.53 | −3.17 | 3.78 | −1.52 | 2.36 | −2.10 |
| 2170 | 59% | 3.99 | −0.25 | −3.39 | 3.97 | −1.45 | 2.67 | −2.38 |

TABLE 2

(Antenna on Plastic Casing)

| | 3D | | Azimuth | | Elevation 0° | | Elevation 90° | |
|---|---|---|---|---|---|---|---|---|
| Frequency (MHz) | Efficiency | Max Gain | Max Gain | Average Gain | Max Gain | Average Gain | Max Gain | Average Gain |
| 824 | 62% | 1.38 | 0.06 | −1.67 | 0.73 | −1.96 | 0.51 | −2.86 |
| 869 | 65% | 1.86 | 0.14 | −1.73 | 1.19 | −1.59 | 0.82 | −2.37 |
| 894 | 61% | 1.79 | 0.02 | −1.91 | 1.32 | −1.95 | 1.40 | −2.59 |
| 1710 | 66% | 2.02 | 0.23 | −1.41 | 1.52 | −1.08 | 1.73 | −3.22 |
| 1785 | 69% | 1.96 | 1.63 | −0.83 | 1.70 | −0.95 | 0.15 | −3.48 |
| 1850 | 67% | 1.76 | 0.82 | −1.16 | 1.06 | −1.04 | −0.12 | −3.33 |
| 1920 | 66% | 2.59 | 0.33 | −1.79 | 1.72 | −1.07 | 0.11 | −3.01 |
| 1960 | 64% | 3.42 | 0.21 | −2.43 | 2.01 | −1.09 | 0.95 | −2.72 |
| 1990 | 67% | 3.39 | −0.45 | −2.67 | 2.28 | −0.57 | 1.78 | −2.00 |
| 2110 | 62% | 2.90 | 0.54 | −2.68 | 1.01 | −0.62 | 1.95 | −2.38 |
| 2170 | 54% | 2.10 | 0.76 | −2.55 | 0.55 | −1.51 | 0.20 | −4.85 |

FIGS. 20 and 21 illustrate another exemplary embodiment of an antenna assembly or system 400 embodying one or more aspects of the present disclosure. As disclosed herein, the antenna system 400 is configured to be ground independent, low profile, and have good omnidirectional radiation patterns in a first or low cellular frequency band or range from about 824 megahertz (MHz) to about 894 MHz and a second or high cellular frequency band or range from about 1710 MHz to about 2170 MHz.

As shown in FIG. 20, the antenna assembly 400 includes a patch element 404, a feeding board 408 (broadly, a feed element), a high band element 412 along the back of the feeding board 408, and an annular ground plane or element 416 (e.g., circular ring shaped ground element, etc.). The patch element 404 is configured to be operable for providing basic resonances for both the low band and the high band. The high band element 412 is configured to be operable as an additional radiating element as well as having capacitance to cancel out inductance of the patch element 404, which is at a higher location. The high band element 412 is operable for improving or broadening the bandwidth of the high band by means of introducing capacitance to the antenna assembly 400.

With the annular ground element 416, the antenna assembly 400 may be tuned to have a larger bandwidth while also moving or shifting the resonance to a lower frequency. The internal diameter of the annular ground element 416 can be adjusted to shift the low frequency band resonance. The annular ground element 416 allows reasonable bandwidth for the low frequency band while also offering omnidirectional radiation pattern to the antenna assembly 400.

In this example, the patch element 404 comprises a radiating element 405 (e.g., electrically-conductive trace or other electrically-conductive material, etc.) on a dielectric substrate 407 (e.g., printed circuit board, etc.). The feed element 408 comprises electrically-conductive material 428 (e.g., electrically-conductive traces, etc.) on a dielectric substrate 432 (e.g., printed circuit board, etc.). The high band element 412 comprises a radiating element 420 (e.g., electrically-conductive trace or other electrically-conductive material, etc.) on the back of the dielectric substrate 432 of the feed element 408. In this example, the feeding board 408 is generally rectangular, and the high band element 412 is generally rectangular. The patch element 404 includes a rectangular portion 485 and a curved portion 487 (e.g., partial circular shape, semicircular, etc.).

The curved portion 487 may have a circular perimeter shape that corresponds with (e.g., matches, etc.) the perimeter defined by the inner surface of the radome 474 in order to fully utilize the available space within the radome 474. Alternatively, the patch element 404 may have a different shape depending, for example, on the shape of the radome. For example, another exemplary embodiment may include a patch element 404 configured (e.g., shaped, sized, etc.) such that the patch width increases near the feed for better matching and omnidirectionality of the radiation pattern for high band.

Also, the patch element 404, the feed element 408, and the high band element 412 have generally flat and planar configurations in this example embodiment. Alternative embodiments may include other radiating means and/or other feeding means (e.g., non-planar, non-flat, differently shaped elements, etc.).

As shown in FIG. 22A, the feeding board 408 includes a mounting point 452, a shorting point 456, and a feeding point 460. In this example embodiment, the mounting point 452, shorting point 456, and feeding point 460 comprise soldering pads. For example, the mounting point 452 comprises soldering pads 453 and 455 on the front and back sides of the feeding board 408 for mounting to the annular ground plane 416. The shorting point 456 comprises soldering pads 481 and 483 on the respective front and back sides of the feeding board 408 for shorting to ground. The soldering pads 481, 483 and solder thereon may electrically connect the annular ground plane 416 to the high band element 412 on the back of the feeding board 408 and to the electrically-conductive material 428 on the front of the feeding board 408. The feeding point 460 comprise a soldering pad for feeding of a cable (e.g., coaxial cable, etc.)

The high band element 412 may also be directly coupled electrically (e.g., galvanic electrical connection, etc.) to the electrically-conductive material 428 on the front side of the feeding board 408 via solder at the solder pads 481 and 483. Alternative embodiments may include other means for mechanically and/or electrically coupling a high band element to a feeding component.

The feeding board 408 also includes downwardly extending or protruding portions, projections, or tabs 462 along the bottom of the feeding board 408. The tabs 462 are configured to be positioned within openings 464 (e.g., holes, slots, etc.) in the annular ground plane 416. The tabs 462 comprise portions of the dielectric substrate 432 of the feeding board 408. The solder pads 453, 455 are disposed on the front and back sides of one of the tabs 462, which provides an area for soldering the feeding board 408 to the annular ground plane 416. The tabs 462 comprise portions of the feeding board's dielectric substrate 432, which portions do not include the electrically conductive material 428 thereon. As shown in FIG. 22A, the soldering pads 453, 455 are spaced apart from the electrically-conductive material 428 (feed component) and electrically-conductive material 420 (high band element) on the front and back sides of the feeding board 408. Thus, the solder pads 453, 455 and solder thereon are used to mechanically secure (not electrically connect) the feeding board 408 to the annular ground plane 416.

The feeding board 408 further includes a downwardly extending or protruding portion, projection, or tab 480 configured to be positioned within an opening 482 (e.g., hole, slot, etc.) in the annular ground plane 416. The shorting point 456 is disposed on or defined by the tab 480, which provides an area for soldering and electrically connecting the feeding board 408 to the annular ground plane 416. As shown in FIG. 22A, the soldering pads 481 and 483 are adjacent and in contact with the electrically-conductive material 428 (feed component) and electrically-conductive material 420 (high band element) on the respective front and back sides of the feeding board 408.

The annular ground plane 416 includes a raised or non-planar portion 457 that is above and thus not co-planar with the annular circular outer portion 459 of the annular ground plane 416. The raised portion 457 includes the opening 482. The positioning of the feeding board's tabs 462 and 480 within the respective openings 464 and 482 of the annular ground plane 416 aligns the feeding board 408 and annular ground plane 416 relative to each other, e.g., generally perpendicular, etc. Accordingly, the feeding board 408 may be electrically connected (e.g., shorted, etc.) to the annular ground plane 416 via solder at the soldering pads 481, 483 and mechanically connected to the annular ground plane 416 via solder at the soldering pads 453, 455 after the tabs 462 and 480 of the feeding board 408 are positioned within the openings 464 and 482 of the annular ground plane 416. The feeding board 408 may thus be supported by (e.g., atop, etc.) the annular ground plane 416 as shown in FIG. 20.

The shorting point 456 and soldering pads 481, 483 are preferably positioned to be adjacent or located at about or towards a center of the annular ground plane 416 when the feeding board 408 is coupled to the annular ground plane 416. The feeding point 460 is preferably positioned to be adjacent or located at about or towards an edge of the annular ground plane 416 when the feeding board 408 is coupled to the annular ground plane 416. Stated differently, the shorting point 456 is preferably closer to a center of the annular ground plane 416 than is the feeding point 460. In turn, the feeding point 460 is closer to an edge of the annular ground plane 416 than is the shorting portion 456. These relative locations of the shorting point 456 and feeding point 460 help ensure that the antenna assembly 400 has good omnidirectional radiation patterns (e.g., FIGS. 25 through 32, etc.).

The patch element 404 includes notches or slots 461 configured for slidably receiving tabs or upwardly protruding portions 463 along a top of the feeding board 408. Accordingly, the patch element 404 and feeding board 408 may be aligned relative to each other (e.g., generally perpendicular, etc.) and mechanically coupled together by slidably positioning the tabs 463 of the feeding board 408 into the slots 461 of the patch element 404.

The patch element 404 and feeding board 408 also include respective soldering pads 465 and 467 (FIG. 22A). The soldering pads 465, 467 are aligned and adjacent each other when the patch element 404 and feeding board 408 are mechanically coupled to each via the slots 461 and tabs 463. The patch element 404 may be directly coupled electrically (e.g., galvanic electrical connection, etc.) to the feeding board 408 via solder at the solder pads 465, 467. Accordingly, the patch element 404 may thus be electrically connected (shorted) to the annular ground plane 416 via the feeding board 408, which, in turn, is electrically connected to the annular ground plane 416 via solder at the feeding board's shorting point 456, which includes the solder pad 481. The patch element 404 may also be fed via the feeding board 408, which, in turn, is electrically connected to a feed (e.g., coaxial cable 466, etc.) via solder at the feeding board's feeding point or solder pad 460. The solder at the solder pads 465, 467 may also help to further mechanically couple or secure the feeding board 408 to patch element 404. The patch element 404 may be supported by the feeding board 408 such that the patch element 404 is spaced apart from and generally parallel to the annular ground element 416. Alternative embodiments may include other means for mechanically and/or electrically coupling a patch element to a feeding component.

In addition, the antenna assembly 400 also includes a pigtail or coaxial cable 466 (e.g., RG316 coaxial cable having an SMA connector, etc.). As shown in FIGS. 20 and 21, the coaxial cable 466 is electrically connected to the feeding point 460 of the feeding board 408. The coaxial cable 466 may also be grounded adjacent or near the feeding point 460. For example, an inner conductor of the coaxial cable 466 may be soldered to the soldering pad 460 of the feeding board 408, while an outer braid of the coaxial cable 466 may be soldered to a feature 477 (e.g., cable holder or grounding point, etc.) integrally formed or defined (e.g., stamped, etc.) by the ground plane 416. The coaxial cable 466 is routed from the feeding point 460 and passes through the open center of the annular ground plane 416. The coaxial cable 466 then passes through an electrically-conductive (e.g., aluminum, other metal, etc.) mounting member 468 (FIG. 21).

The mounting member 468 may comprise a threaded stud or stub (broadly, threaded portion) protruding outwardly relative to a base 469 (e.g., dielectric base, plastic base, etc.). As shown in FIG. 21, the base 469 includes at least one upwardly protruding portion (e.g., plastic material, etc.) operable as a locating pin 471. The locating pin 471 is configured to be at least partially received within a corresponding opening or hole 472 in the annular ground plane 416 for aligning or locating the annular ground plane 416 in its correct orientation relative to the base 469.

The mounting member 468 allows the antenna assembly 400 to be mounted to a support surface (e.g., planar surface, etc.) via one or more nuts 470 (FIG. 24) that are threaded onto the mounting member 468. A washer 473 may also be positioned on the mounting member 468 between the nut 470 and a sealing member or gasket 475 (e.g., foam pad, etc.). By way of example, the antenna assembly 400 may be mounted to a ceiling by positioning the base 469 on one side of the ceiling and positioning and threading the nut 470 onto the threaded portion 468 on the opposite side of the ceiling. Accordingly, this exemplary embodiment of the antenna assembly 400 is operable in multiple frequency bands with a single port. Alternative embodiments may include other feeding arrangements or means for feeding the antenna assembly besides coaxial cables (e.g., transmission lines, have more than a single port, etc.) and/or other mounting arrangements or means besides an aluminum threaded stud.

If the antenna assembly 400 is mounted to an electrically-conductive (e.g., metal, etc.) external ground plane, the external ground plane is grounded and electrically connected only to the threaded mounting member 468 of the antenna assembly 400. Though this grounding of the mounting member 468 with the external ground plane may reduce omnidirectionality at the highest frequency band edge of the antenna assembly 400, it may also allow the antenna assembly 400 to have broader bandwidth. Depending on the particular application and operating requirements, the antenna assembly 400 may thus be used either on an external electrically-conductive (ground plane) mounting surface or a dielectric (non-ground plane) mounting surface.

As shown in FIGS. 21, 23, and 24, the antenna assembly 400 may also include a radome or housing 474 (e.g., plastic molded radome having a generally hockey puck shape, etc.). The radome 474 may be positioned over the patch element 404, feeding board 408, high band element 412, and annular ground plane 416 and then be coupled (e.g., mechanically fastened, etc.) to the base 469. A sealing member 479 (e.g., sealing O-ring, etc.) may be disposed between the annular ground plane 416 and the base 469. By way of example only, the radome 474 may comprise polycarbonate, black and have a diameter of about 90 millimeters and a height of about 26 millimeters. But these specific materials and dimensions (as are all specific materials and dimensions disclosed herein) are only examples as other embodiments may be made out of different materials and/or dimensionally sized larger or smaller.

By way of example only, a prototype of the antenna assembly 400 was operable in a low band from about 824 MHz to about 894 MHz and a high band from about 1710 MHz to about 2170 MHz. The antenna 400 was RoHS compliant and had a VSWR of 3:1 or less and nominal impedance of 50 ohms. The antenna 400 also had a linear vertical polarization and produced omnidirectional radiation patterns (as shown in FIGS. 25 through 32). The prototype antenna had a diameter of 90 millimeters and a height of 26 millimeters. Gain and efficiency were measured for the prototype antenna on a metal housing and on a plastic housing. An RG316 (24 millimeters long) cable terminated with an SMA connector was used during the testing. The prototype antenna on the metal housing had a maximum gain of 2.5 dBi for 880-960 MHz, 5 dBi for 1710-1880 MHz, 3.9 dBi for 1850-1990 MHz, and 3.9 for 1910-2170 MHz. The prototype antenna on the plastic housing had a maximum gain of 3.4 dBi for 880-960 MHz, 2.1 dBi for 1710-1880 MHz, 2.5 dBi for 1850-1990 MHz, and 3 for 1910-2170 MHz. The metal housing test condition was represented by a 300 millimeter (mm) diameter aluminum plate. The plastic housing test condition was represented by 255 mm×255 mm×2 mm plastic base. The above operating characteristics and dimensions are provided for purposes of illustration only as other exemplary embodiments may be configured differently, e.g., have different operating characteristics, be sized smaller or larger, etc.

FIGS. 25 through 32 illustrate radiation patterns measured for a prototype of the antenna assembly 400 when respectively mounted on a metal ground plane or housing and on a plastic casing or housing with the pattern orientation shown in FIG. 13 at frequencies of about 880 MHz, 960 MHz, 1710 MHz, 1740 MHz, 1880 MHz, 1950 MHz, 2110 MHz, and 2170 MHz, respectively. Generally, FIGS. 25 through 32 show that the antenna assembly 400 has good omnidirectional radiation patterns at both low band and high band when mounted on a metal ground plane or housing and when mounted on a non-ground plane (e.g., a plastic casing or housing, etc.). These analysis results are provided only for purposes of illustration and not for purposes of limitation.

Accordingly, the antenna assembly 400 is ground independent such that the antenna assembly 400 does not depend on or have to be used with a separate, external, or additional ground plane, such as an electrically-conductive (e.g., metal, etc.) mounting surface, etc. For example, the antenna assembly 400 may provide good omnidirectional radiation patterns at multiple frequency bands while using only its own internal annular ground plane 416 and without any additional external ground plane. The antenna assembly 400 may also provide good omnidirectional radiation patterns at multiple frequency bands when mounted to an additional external ground plane. The antenna assembly 400 has good omnidirectional radiation patterns at multiple frequency bands regardless of whether or not the antenna assembly 400 is mounted on a ground plane, thereby providing flexibility for different antenna mounting scenarios.

Exemplary embodiments of the antenna assemblies and systems are disclosed herein that allow multiple operating bands for wireless communications devices. By way of example, an antenna assembly as disclosed herein may be configured to be operable or cover FDD (Frequency Division Duplex) and TDD (Time Division Duplex) LTE (Long Term Evolution) frequency bands (Table 3 below) as defined by 3GPP ($3^{rd}$ Generation Partnership Project). By way of background, different frequency bands are used for send and receive operations with the FDD technique so that sending and receiving data signals doesn't interfere with each other. By comparison, the TDD technique allocates different time slots in the same frequency band to separate uplink from downlink. In exemplary embodiments, the antenna assembly is operable in a 824-894 MHz low band and a 1710-2170 MHz high band. In other exemplary embodiments, the antenna assembly may be tweaked or reconfigured for various frequency ranges depending, for example, on the height or size requirement for the antenna assembly. Therefore, exemplary embodiments are not limited to operation in a 824-894 MHz low band and 1710-2170 MHz high band or limited to having a 90 millimeter diameter or 26 millimeter height.

TABLE 3

| Band | Uplinks MHz | Downlink MHz | |
|---|---|---|---|
| 1 | 1920-1980 | 2110-2170 | FDD |
| 2 | 1850-1910 | 1930-1990 | FDD |
| 3 | 1710-1785 | 1805-1880 | FDD |
| 4 | 1710-1755 | 2110-2155 | FDD |
| 5 | 824-849 | 869-894 | FDD |
| 6 | 830-840 | 875-885 | FDD |
| 7 | 2500-2570 | 2620-2690 | FDD |
| 8 | 880-915 | 925-960 | FDD |
| 9 | 1749-1784 | 1844-1879 | FDD |
| 10 | 1710-1770 | 2110-2170 | FDD |
| 12 | 698-716 | 728-746 | FDD |
| 13 | 777-787 | 746-756 | FDD |
| 14 | 788-798 | 758-768 | FDD |
| 17 | 704-716 | 734-746 | FDD |
| 18 | 815-830 | 860-875 | FDD |
| 19 | 830-845 | 875-890 | FDD |
| 20 | 832-862 | 791-821 | FDD |
| 33 | 1900-1920 | 1900-1920 | TDD |
| 34 | 2010-2025 | 2010-2025 | TDD |
| 35 | 1850-1910 | 1850-1910 | TDD |
| 36 | 1930-1990 | 1930-1990 | TDD |
| 37 | 1910-1930 | 1910-1930 | TDD |
| 38 | 2570-2620 | 2570-2620 | TDD |
| 39 | 1880-1920 | 1880-1920 | TDD |
| 40 | 2300-2400 | 2300-2400 | TDD |

In exemplary embodiments, an antenna assembly or system may be configured to be operable for covering some of the above-listed frequency bands with good voltage standing wave ratios (VSWR) and with relatively good efficiency. Alternative embodiments may include an antenna assembly or system operable at less than or more than all of the above-identified frequencies and/or be operable at different frequencies than the above-identified frequencies.

Exemplary embodiments of the antenna assemblies or systems (e.g., 100, 200, 300, 400, etc.) disclosed herein are suitable for a wide range of applications, e.g., machine to machine (M2M), vehicular, customer premises equipment (CPE), satellite navigation systems, alarm systems, terminal stations, central stations, in-building antenna systems, etc. Accordingly, the antenna systems disclosed herein should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances (e.g., angle+/−30', 0-place decimal+/−0.5, 1-place decimal+/−0.25, 2-place decimal+/−0.13, etc.). Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly operable within at least a first frequency range and a second frequency range different than the first frequency range, the antenna assembly comprising:

an annular ground element;

a feed element including a feeding point and a shorting point electrically connected to the annular ground element, the feeding point is adjacent an edge portion of the feed element, the shorting point is spaced apart from the feeding point and the edge portion of the feed element, the feed element is coupled to the annular ground element such that the shorting point is closer to a center of the annular ground element than is the feeding point and such that the feeding point is closer to an edge of the annular ground element than is the shorting point;

a patch element electrically shorted to the annular ground element by the feed element; and a high band element;

whereby the antenna assembly is ground independent when operating in the first and second frequency ranges.

2. The antenna assembly of claim 1, further comprising a coaxial cable having an inner conductor soldered to the feeding point of the feed element, wherein the coaxial cable is electrically grounded to the annular ground element adjacent the feeding point and routed through a central opening of the annular ground element.

3. The antenna assembly of claim 1, wherein the feed element and the patch element each comprises electrically-conductive material on a dielectric substrate;

the patch element is coupled to and/or supported by an upper portion of the feed element such that the patch element is generally perpendicular to the feed element and generally parallel to the high band element and the annular ground element; and the feed element is coupled to and/or supported by the annular ground element such that the feed element is generally perpendicular to the annular ground element.

4. The antenna assembly of claim 1, wherein:

the feed element comprises electrically-conductive material on a front side of a dielectric substrate; and the high band element comprises electrically-conductive material on a back side of the dielectric substrate.

5. The antenna assembly of claim 4, further comprising solder pads on the front and back sides of the dielectric substrate, and wherein the high band element is electrically-connected to the electrically-conductive material on the front side of the dielectric substrate by the solder pads and solder on the solder pads.

6. The antenna assembly of claim 1, further comprising a base and a radome having a low profile and coupled to the base, wherein the annular ground element, the feed element, the patch element, and the high band element are within an internal spaced cooperatively defined between the radome and the base.

7. The antenna assembly of claim 1, wherein:

the high band element is configured to be operable for improving bandwidth of the second frequency range by introducing capacitance; and/or the annular ground element enables tuning of the antenna assembly to have a larger bandwidth while also shifting resonance to a lower frequency.

8. A machine to machine antenna system comprising the antenna assembly of claim 1.

9. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element; and a high band element;

wherein:

the patch element is configured to be operable for providing basic resonances for the first and second frequency ranges; and the high band element is configured to be operable as an additional radiating element and having capacitance for cancelling out inductance of the patch element, whereby the high band element is operable for improving bandwidth of the second frequency range by introducing capacitances;

whereby the antenna assembly is ground independent when operating in the first and second frequency ranges.

10. The antenna assembly of claim 9, wherein:

the feeding point is adjacent an edge portion of the feed element;

the shorting point is spaced apart from the feeding point and the edge portion of the feed element;

the feed element is coupled to the annular ground element such that:

the shorting point is closer to a center of the annular ground element than is the feeding point; and the feeding point is closer to an edge of the annular ground element than is the shorting point.

11. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element; and a high band element;

whereby the antenna assembly is ground independent when operating in the first and second frequency ranges;

wherein the antenna assembly is not dependent on a separate external ground plane, whereby the antenna assembly is operable omnidirectionally with linear polarization in the first and second frequency ranges with a voltage standing wave ratio of 3:1 or less whether the antenna assembly is mounted to a dielectric, non-ground plane mounting surface or mounted to an electrically-conductive mounting surface operable as an electrically large ground plane.

12. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element; and a high band element;

whereby the antenna assembly is ground independent when operating in the first and second frequency ranges;

wherein:

the first frequency range is from about 824 megahertz to about 894 megahertz;

the second frequency range is from about 1710 megahertz to about 2170 megahertz; and the antenna assembly is ground independent such that the antenna assembly is operable with omnidirectional and linear polarization in the first and second frequency ranges with a voltage standing wave ratio of 3:1 or less whether mounted to a ground plane or a non-ground plane.

13. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element;

a high band element; and a coaxial cable having an inner conductor soldered to the feeding point of the feed element, wherein the coaxial cable is electrically grounded to the annular ground element adjacent the feeding point and routed through a central opening of the annular ground element;

whereby the antenna assembly is ground independent when operating in the first and second frequency ranges;

wherein:

the annular ground element includes an integrally formed feature to which an outer braid of the coaxial cable is soldered;

the antenna assembly includes a single port through which the antenna assembly provides multi-band operation;

the antenna assembly further comprising a threaded mounting member for mounting the antenna assembly to a support surface; and the coaxial cable is routed from the central opening of the annular ground element through a central opening of the threaded mounting member.

14. An antenna assembly operable within at least a first frequency range and a second frequency range different than the first frequency range, the antenna assembly comprising:

an annular ground element;

a feed element including a feeding point and a shorting point electrically connected to the annular ground element, the feed element is electrically connected to the annular ground element by solder on a solder pad on the shorting point;

a patch element electrically shorted to the annular ground element by the feed element, the patch element is electrically connected to the feed element by solder on solder pads of the patch element and solder pads of the feed element; and a high band element;

whereby the antenna assembly is ground independent when operating in the first and second frequency ranges.

15. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element, the patch element includes slots configured for slidably receiving tabs along a top of the feed element, whereby the patch element and the feed element are aligned relative to each other and mechanically coupled by the tabs of the feed element within the slots of the patch element; and a high band element;

wherein the annular ground element includes slots configured for slidably receiving tabs along a bottom of the feed element, whereby the feed element and the annular ground element are aligned relative to each other and mechanically coupled by the tabs of the feed element within the slots of the annular ground element; and whereby the antenna assembly is ground independent when operating in the first and second frequency ranges.

16. The antenna assembly of claim 15, wherein the high band element includes a slot configured for slidably receiving an edge portion of the feed element, the feed element includes a slot configured for slidably receiving an edge portion of the high band element, whereby the high band element and the feed element are aligned relative to each other and mechanically coupled by the edge portion of the high band element within the slot of the feed element and the edge portion of the feed element within the slot of the high band element.

17. An antenna assembly operable within at least a first frequency range and a second frequency range different than the first frequency range, the antenna assembly comprising:

an annular ground element;

a feed element including a feeding point and a shorting point electrically connected to the annular ground element;

a patch element electrically shorted to the annular ground element by the feed element; and a high band element;

whereby the antenna assembly is ground independent when operating in the first and second frequency ranges;

wherein:

each of the feed element, the patch element, and the high band element comprises electrically-conductive material on a generally flat or planar dielectric substrate;

the patch element is coupled to and/or support by an upper portion of the feed element such that the patch element is generally perpendicular to the feed element and generally parallel to the high band element and the annular ground element;

the high band element is coupled to and/or supported by an edge portion of the feed element such that the high band element is generally perpendicular to the feed element and generally parallel to the patch element and the annular ground element; and the feed element is coupled to and/or supported by the annular ground element such that the feed element is generally perpendicular to the annular ground element.

18. The antenna assembly of claim 17, wherein:

the patch element includes slots configured for slidably receiving tabs along the upper portion of the feed element;

the annular ground element includes slots configured for slidably receiving tabs along a lower portion of the feed element;

the high band element includes a slot configured for slidably receiving the edge portion of the feed element, the feed element includes a slot configured for slidably receiving an edge portion of the high band element.

* * * * *